US007833092B2

(12) United States Patent
Wolf et al.

(10) Patent No.: US 7,833,092 B2
(45) Date of Patent: Nov. 16, 2010

(54) METHOD AND SYSTEM FOR COMPENSATING FOR PLAYER CHOICE IN A GAME OF CHANCE

(75) Inventors: Bryan Wolf, Reno, NV (US); David Oles, Henderson, NV (US)

(73) Assignee: IGT, Reno, NV (US)

( * ) Notice: Subject to any disclaimer, the term of this patent is extended or adjusted under 35 U.S.C. 154(b) by 1603 days.

(21) Appl. No.: 11/020,416

(22) Filed: Dec. 21, 2004

(65) Prior Publication Data

US 2006/0135241 A1 Jun. 22, 2006

(51) Int. Cl.
*A63F 13/00* (2006.01)

(52) U.S. Cl. ..... 463/16; 273/138.1; 273/138.2

(58) Field of Classification Search ..... 463/16; 273/138.1, 138.2
See application file for complete search history.

(56) References Cited

U.S. PATENT DOCUMENTS 4,448,419 A * 5/1984 Telnaes ..... 463/21
4,711,451 A * 12/1987 Pajak et al. ..... 463/22
4,858,932 A * 8/1989 Keane ..... 463/21
5,058,893 A * 10/1991 Dickinson et al. ..... 273/143 R
5,370,399 A * 12/1994 Liverance ..... 463/23
5,380,008 A * 1/1995 Mathis et al. ..... 463/18
5,524,888 A * 6/1996 Heidel ..... 463/22
5,584,763 A * 12/1996 Kelly et al. ..... 463/16
5,725,428 A * 3/1998 Achmuller ..... 463/20
5,823,874 A * 10/1998 Adams ..... 463/17
5,833,538 A * 11/1998 Weiss ..... 463/21
5,848,932 A * 12/1998 Adams ..... 463/20
5,910,048 A * 6/1999 Feinberg ..... 463/25
6,053,813 A * 4/2000 Mathis ..... 463/26
6,117,009 A * 9/2000 Yoseloff ..... 463/20
6,334,614 B1 * 1/2002 Breeding ..... 273/292
6,347,795 B1 * 2/2002 De Leljer ..... 273/143 R
6,398,220 B1 * 6/2002 Inoue ..... 273/142 R
6,409,172 B1 * 6/2002 Vancura ..... 273/256
6,533,273 B2 * 3/2003 Cole et al. ..... 273/138.1
6,533,664 B1 3/2003 Crumby
6,569,015 B1 * 5/2003 Baerlocher et al. ..... 463/16
6,676,510 B1 * 1/2004 Bittman et al. ..... 463/20
6,705,944 B2 * 3/2004 Luciano ..... 463/20
6,793,577 B1 9/2004 Wilkins et al.
6,802,507 B2 * 10/2004 Inoue ..... 273/143 R
6,902,479 B1 * 6/2005 D'Avanzo ..... 463/18
6,905,407 B2 * 6/2005 Nordman ..... 463/20

(Continued)

*Primary Examiner*—Peter DungBa Vo
*Assistant Examiner*—William H McCulloch
(74) *Attorney, Agent, or Firm*—Weaver Austin Villeneuve & Sampson LLP

(57) ABSTRACT

Disclosed are methods and apparatus, including computer program products, implementing and using techniques for compensating for a player choice in a game of chance. A plurality of outcomes is defined. A sequence of positions corresponding to the plurality of outcomes is provided, including a reference position. A plurality of pointers is situated at positions in the sequence. Each pointer has an offset value with respect to the reference position along the sequence of positions. Responsive to selection of one of the pointers, the reference position is moved according to the offset value associated with the selected one pointer, so that the selected one pointer points at the reference position. A number is received. The received number determines one of the plurality of outcomes according to a predefined probability associated with the reference position. The determined one outcome is output at the reference position.

34 Claims, 10 Drawing Sheets

U.S. PATENT DOCUMENTS 6,918,830 B2 * 7/2005 Baerlocher ..... 463/16
7,083,168 B2 * 8/2006 Seelig et al. ..... 273/142 HA
7,112,134 B1 * 9/2006 Erlichman ..... 463/16
7,235,011 B2 * 6/2007 Randall et al. ..... 463/25
7,278,638 B2 * 10/2007 Nordman ..... 273/292
7,278,916 B2 * 10/2007 Boyd et al. ..... 463/16
7,278,919 B2 * 10/2007 Souza et al. ..... 463/25
7,309,285 B2 * 12/2007 Nordman et al. ..... 463/31
D558,835 S * 1/2008 Zielinski et al. ..... D21/385
7,329,182 B2 * 2/2008 Adams et al. ..... 463/20
7,331,863 B2 * 2/2008 Baerlocher ..... 463/20
D569,919 S * 5/2008 Zielinski ..... D21/370
7,442,123 B2 * 10/2008 Brill et al. ..... 463/20
7,448,948 B2 * 11/2008 Hughs-Baird et al. ..... 463/20
7,488,253 B2 * 2/2009 Nordman et al. ..... 463/31
7,491,121 B2 * 2/2009 Seelig et al. ..... 463/20
7,559,840 B1 * 7/2009 D'Avanzo ..... 463/30
7,614,951 B2 * 11/2009 Flemming et al. ..... 463/20
7,625,278 B2 * 12/2009 Paulsen et al. ..... 463/16
7,690,978 B2 * 4/2010 Webb et al. ..... 463/16
7,731,582 B2 * 6/2010 Randall et al. ..... 463/20
7,749,074 B2 * 7/2010 Cole et al. ..... 463/21
2001/0034260 A1 * 10/2001 Luciano et al. ..... 463/16
2002/0065126 A1 * 5/2002 Miller et al. ..... 463/20
2002/0086728 A1 * 7/2002 Bennett et al. ..... 463/25
2002/0193158 A1 * 12/2002 Weiss et al. ..... 463/16
2003/0040355 A1 * 2/2003 Baerlocher ..... 463/20
2003/0104856 A1 * 6/2003 Wolf ..... 463/16
2004/0023713 A1 * 2/2004 Wolf et al. ..... 463/20
2004/0053665 A1 * 3/2004 Baerlocher ..... 463/16
2004/0147306 A1 * 7/2004 Randall et al. ..... 463/20
2004/0180717 A1 * 9/2004 Vancura ..... 463/20
2004/0242316 A1 * 12/2004 Oles et al. ..... 463/20
2005/0143156 A1 * 6/2005 Herrmann et al. ..... 463/9
2005/0181874 A1 * 8/2005 Bond ..... 463/36
2006/0172791 A1 * 8/2006 Wolf ..... 463/16
2008/0004098 A1 * 1/2008 Bennett ..... 463/16
2008/0227530 A1 * 9/2008 LeMay et al. ..... 463/22
2009/0011826 A1 * 1/2009 Acres ..... 463/27

* cited by examiner

METHOD AND SYSTEM FOR COMPENSATING FOR PLAYER CHOICE IN A GAME OF CHANCE

BACKGROUND OF THE INVENTION

The present disclosure relates to gaming machines and networks and, more particularly, to games of chance involving player input and selection, such as a Wheel of Fortune® game.

Gaming in the United States is divided into Class I, Class II and Class III games. Class I gaming includes social games played for minimal prizes, or traditional ceremonial games. Class II gaming includes bingo games, pull tab games if played in the same location as bingo games, lotto, punch boards, tip jars, instant bingo, and other games similar to bingo. Class II games can be implemented in a Central Determination configuration, in which a central computer or system determines game outcomes regardless of any player input or decisions. Class III gaming includes any game that is not a Class I or Class II game, such as a game of chance typically offered in non-Indian, state-regulated casinos. Many games of chance that are played on gaming machines fall into the Class II and Class III categories of games.

One trend in the design of Class III games is the reliance upon player input for determining the outcome of a game, when several outcomes are possible. Games that involve player choice are generally more interesting for game players because of the increased enjoyment of participation in the game. For example, in a Wheel of Fortune® game, as shown in FIG. 1, the player is presented with a wheel 100 with outcomes disposed about the center of the wheel in a pie configuration, as shown. In this example, the player sees 12 possible outcomes or award amounts. The particular amount awarded to the player depends on which outcome the pointer 105 points to when the wheel stops after it is spun. In the example of FIG. 1, the wheel 100 has been spun and stopped with the pointer 105 pointing to a $30 amount. Thus, the player is awarded $30 from this spin.

In FIG. 2, the wheel 100 is shown from the perspective of a gaming machine on which the Wheel of Fortune® game is played. In FIG. 2, the gaming machine manages the particular outcomes or award amounts of FIG. 1 as a number of stops corresponding to the number of award amounts. For instance, in this example, stop 10 is associated with the $150 amount, stop 9 is associated with the $50 amount, stop 8 is associated with the $15 amount, stop 7 is associated with the $75 amount, and so forth. Thus, when the wheel stops with the pointer 105 pointing at the $30 award amount, the gaming machine has selected the associated stop 0 as the outcome, providing that award amount.

In generating outcomes for a game of chance, a pay table is often used. The pay table contains the award amounts, or "payouts" associated with each stop. In addition, the pay table includes a set of fixed probabilities associated with each stop and associated award amount. In this way, the outcome on any given spin or play is randomly determined according to the fixed probabilities defined in the pay table. For example, in Table 1 below, the stops and associated payouts or award amounts of FIGS. 1 and 2 are shown with associated weights in the far-right column. Thus, stop 1, with a weight of 14, is generally the most likely outcome. Those skilled in the art will appreciate that the weights in the far-right column of Table 1 can be divided by the sum of all the weights for Table 1 to show the corresponding probability for each weight.

TABLE 1

| Stop | Payout | Weight |
|---|---|---|
| 0 | 30 | 9 |
| 1 | 20 | 14 |
| 2 | 65 | 8 |
| 3 | 25 | 10 |
| 4 | 500 | 2 |
| 5 | 50 | 11 |
| 6 | 40 | 10 |
| 7 | 75 | 9 |
| 8 | 15 | 10 |
| 9 | 50 | 10 |
| 10 | 150 | 2 |
| 11 | 25 | 10 |

In some implementations, the weights, as shown in Table 1, define a range of Random Number Generator (RNG) values that will determine the stop. For example, in Table 2, the weight associated with stop 0 is 9, so this weight is assigned a range of nine numbers, 0-8. Similarly, the weight associated with stop 1 is 14, so this stop is assigned the next thirteen numbers, 9-22. The range of numbers associated with each of the remaining stops is similarly calculated, as shown in Table 2.

TABLE 2

| Stop | Payout | Weight | Range |
|---|---|---|---|
| 0 | 30 | 9 | 0-8 |
| 1 | 20 | 14 | 9-22 |
| 2 | 65 | 8 | 23-30 |
| 3 | 25 | 10 | 31-40 |
| 4 | 500 | 2 | 41-42 |
| 5 | 50 | 11 | 43-53 |
| 6 | 40 | 10 | 54-63 |
| 7 | 75 | 9 | 64-72 |
| 8 | 15 | 10 | 73-82 |
| 9 | 50 | 10 | 83-92 |
| 10 | 150 | 2 | 93-94 |
| 11 | 25 | 10 | 95-104 |

When the gaming machine randomly determines one of the stops, using the pay table shown in Table 2, the gaming machine will generate a number from 0 to 104. Then, the stop having the range in which the generated number falls is the stop determined for the outcome of the game, or spin in the Wheel of Fortune® example. For instance, using Table 2, when the random number 38 is generated, stop 3 is selected.

Payout weights and an average payout for the pay table can be calculated. This average payout is the average award a player can expect to receive for a game play session, e.g., spin. Table 3 below incorporates the same "stop," "payout," and "weight" entries of Tables 1 and 2. In addition, a fourth column in Table 3 below shows the payout weight associated with each stop in the pay table. This payout weight is calculated by multiplying the payout of the particular stop with the weight associated with that stop. Thus, the payout weight for stop 0 is 9·30=270. Similarly, the payout weight for stop 2 is 8·65=520.

TABLE 3

| Stop | Payout | Weight | Payout * Weight |
|---|---|---|---|
| 0 | 30 | 9 | 270 |
| 1 | 20 | 14 | 280 |
| 2 | 65 | 8 | 520 |
| 3 | 25 | 10 | 250 |

TABLE 3-continued

| Stop | Payout | Weight | Payout * Weight |
|---|---|---|---|
| 4 | 500 | 2 | 1000 |
| 5 | 50 | 11 | 550 |
| 6 | 40 | 10 | 400 |
| 7 | 75 | 9 | 675 |
| 8 | 15 | 10 | 150 |
| 9 | 50 | 10 | 500 |
| 10 | 150 | 2 | 300 |
| 11 | 25 | 10 | 250 |
| | Total | 105 | 5145 |
| | | Average | 49 |

In Table 3, when all of the payout weights are calculated for the stops in the pay table, the total payout weight can be divided by the sum of all of the weights to determine the average payout, i.e. 5145/105=49. Thus, in a game applying the pay structure of Table 3, the player can expect an average payout of $49.

As mentioned above, a trend in modern gaming is to allow a player to make a selection to influence the outcome of a game. In one implementation of this trend, Wheel of Fortune® games have been designed to allow a player to select one of a plurality of pointers when spinning the wheel. Thus, the award amount will depend on which pointer the player selected. For example, FIG. 3 shows wheel 100 of FIGS. 1 and 2. In addition to pointer 105, the implementation of FIG. 3 includes pointers 305 and 310. These pointers are situated as desired about the wheel, as shown in FIG. 3. In one example, as shown in FIG. 4, the pointers have respective colors. For example, pointer 105 is red, pointer 305 is blue, and pointer 310 is yellow. Before the player spins the wheel, the player chooses which pointer, red, blue or yellow, to play. After the wheel is spun, the player is given the award indicated by the pointer chosen.

While FIG. 3 shows the addition of pointers 305 and 310 to wheel 100, the functionality of the gaming machine in determining an outcome is essentially the same as that described above with respect to FIGS. 1 and 2 and Tables 1-3. That is, the gaming machine manages the wheel as a collection of stops. In FIG. 4, the view of the wheel from the perspective of the gaming machine is shown. As one can see, the stops are the same as the stops set forth in FIG. 2. The only difference is the inclusion of the additional pointers. However, these pointers do not have any impact on the operation of the gaming machine in generating outcomes or stops. The gaming machine determines a stop or outcome for red pointer 105, as in FIGS. 1 and 2 above.

Thus, in the example of FIGS. 3 and 4, after the wheel is spun, applying the pay tables of Tables 1-3, the gaming machine determines that stop 0, or the award of $30, will be the outcome. Thus, the wheel stops with pointer 105 pointing at stop 0 or $30, as in FIGS. 1 and 2. However, the additional variable in FIGS. 3 and 4 is the opportunity of the player to select the blue pointer 305 or yellow pointer 310. As shown in FIG. 4, when the wheel stops at stop 0, the red pointer points at stop 0. The blue pointer, however, points at stop 2, and the yellow pointer points at stop 6. Thus, even though the gaming machine operates in the same manner as described above, the final outcome or payout awarded is dependent on the player's selected pointer. In the example shown in FIGS. 3 and 4, if the player had selected the blue pointer, a $65 payout would have been awarded. If the player had selected the yellow pointer, a $40 payout would have been awarded. Accordingly, the dependence upon player choice in FIGS. 3 and 4 affects the average payout, unlike the single pointer scenario described above with reference to FIGS. 1 and 2.

Table 4 shows the payouts associated with the respective pointers of FIGS. 3 and 4.

TABLE 4

| Machine Selected Stop | Weight | Red Pointer Payout | Payout Weight at Red Pointer | Blue Pointer Payout | Payout Weight at Blue Pointer | Yellow Pointer Payout | Payout Weight at Yellow Pointer |
|---|---|---|---|---|---|---|---|
| 0 | 9 | 30 | 270 | 65 | 585 | 40 | 360 |
| 1 | 14 | 20 | 280 | 25 | 350 | 75 | 1050 |
| 2 | 8 | 65 | 520 | 500 | 4000 | 15 | 120 |
| 3 | 10 | 25 | 250 | 50 | 500 | 50 | 500 |
| 4 | 2 | 500 | 1000 | 40 | 80 | 150 | 300 |
| 5 | 11 | 50 | 550 | 75 | 825 | 25 | 275 |
| 6 | 10 | 40 | 400 | 15 | 150 | 30 | 300 |
| 7 | 9 | 75 | 675 | 50 | 450 | 20 | 180 |
| 8 | 10 | 15 | 150 | 150 | 1500 | 65 | 650 |
| 9 | 10 | 50 | 500 | 25 | 250 | 25 | 250 |
| 10 | 2 | 150 | 300 | 30 | 60 | 500 | 1000 |
| 11 | 10 | 25 | 250 | 20 | 200 | 50 | 500 |
| Totals | 105 | | 5145 | | 8950 | | 5485 |
| | | Averages | 49 | | 85.2381 | | 52.2381 |

In the table above, one can see that when the gaming machine generates a stop of 0, then the red pointer would award the player $30, but the blue pointer would award the player $65. The probability of the $30 payout landing on position 0 is the same as the probability of the $65 payout landing on the blue pointer. However, the probability of the $30 payout landing on the red pointer is not the same as the probability of the $30 payout landing on the blue pointer. Thus, it should be clear from Table 4 that the probability of a certain outcome or payout amount at the red pointer is not the same as the probability that the same amount will be output at the blue pointer or yellow pointer. Each pointer has a different set of probabilities or weights assigned to its outcomes or payout amounts.

In Table 4 above, average payouts can be calculated for the respective pointers, applying the same computations described above with respect to Table 3. Thus, when the player selects the red pointer, he can expect an average payout of $49, the same as Table 3. If, however, the player selects the blue pointer, he can expect to receive an average payout of $85.2381. If the player selects the yellow pointer, he can expect an average payout of $52.2381.

As shown in Table 4 above, the blue pointer has a higher average payout than the other pointers. When the player learns the pointer with the highest average yield, either from discovering the pay table or gathering general knowledge from experience, the player will always choose the pointer having the highest average yield. Thus, in Table 4 above, if the player were aware of the average payouts of the respective pointers, the player would always pick the blue pointer. Such discovery is inevitable in the gaming world. When this discovery is made, the entertainment associated with the fundamental game play feature of pointer selection is removed. The entertainment value of the entire game is significantly reduced, and the game can become unexciting.

It is therefore desirable to implement a game of chance involving player choice in a Central Determination, Class II/Bingo gaming system, and a Class III configuration to provide the enjoyment associated with increased participation in the game, but compensate for the player choice to produce the same average payout regardless of the player selection.

SUMMARY OF THE INVENTION

Disclosed are methods and apparatus, including computer program products, implementing and using techniques for compensating for a player choice in a game of chance. In one aspect, a plurality of outcomes is defined. A sequence of positions corresponding to the plurality of outcomes is provided. The sequence of positions includes a reference position. A plurality of pointers are situated at positions in the sequence. Each pointer has an offset value with respect to the reference position along the sequence of positions. Responsive to selection of one of the pointers, the reference position is moved according to the offset value associated with the selected one pointer, so that the selected one pointer points at the reference position. A number is received. The received number determines one of the plurality of outcomes according to a predefined probability associated with the reference position. The determined one outcome is output at the reference position.

In another aspect of the present invention, a plurality of pay tables are provided. Each pay table is associated with a respective one of the plurality of pointers. Each pay table also stores a set of predefined probabilities for the set of outcomes. Responsive to selection of one of the pointers, one of the pay tables is selected. The received number determines one of the plurality of outcomes in the selected pay table according to the predefined probability for the determined one outcome in the selected pay table.

All of the foregoing methods, along with other methods of aspects of the present invention, may be implemented in software, firmware, hardware and combinations thereof. For example, the methods of aspects of the present invention may be implemented by computer programs embodied in non-transitory machine-readable media and other products.

Aspects of the invention may be implemented by networked gaming machines, game servers and other such devices. These and other features and benefits of aspects of the invention will be described in more detail below with reference to the associated drawings.

DETAILED DESCRIPTION OF THE EMBODIMENTS

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. Moreover, numerous specific details are set forth below in order to provide a thorough understanding of the present invention. The present invention may be practiced without some or all of these specific details. In other instances, well known process operations have not been described in detail in order not to obscure the present invention.

Figure 1:
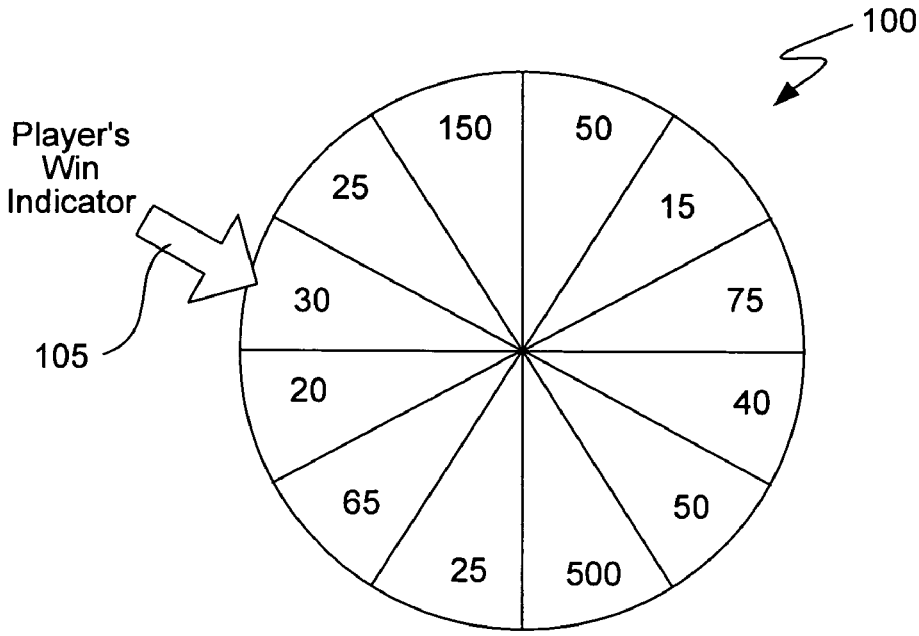
FIG. 1 (PRIOR ART)
FIG. 1 shows an illustration of a conventional Wheel of Fortune® game 100.
Figure 2:
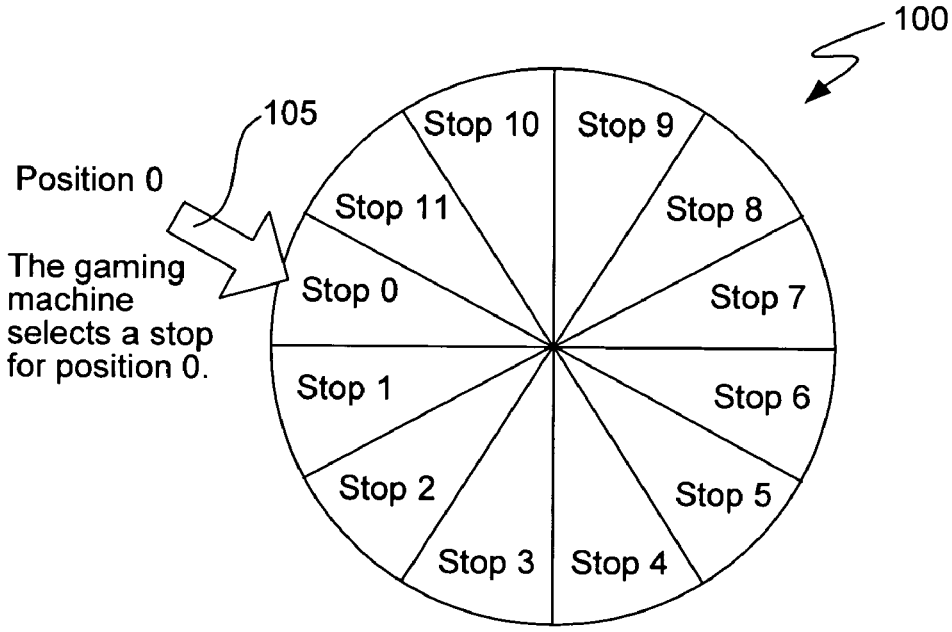
FIG. 2 (PRIOR ART)
FIG. 2 shows an alternative illustration of the conventional Wheel of Fortune® game 100.
Figure 3:
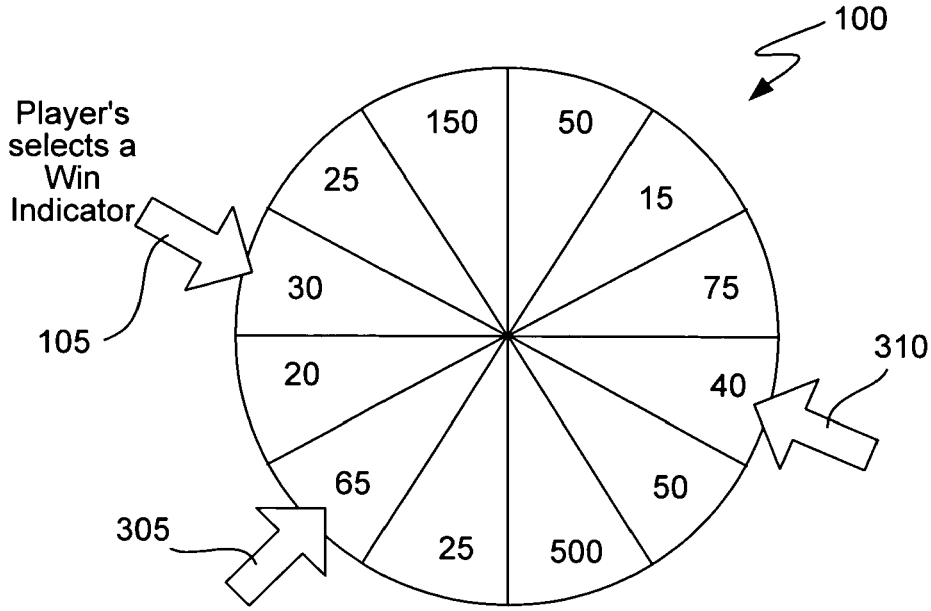
FIG. 3 (PRIOR ART)
FIG. 3 shows an illustration of conventional Wheel of Fortune® game 100 with additional pointers 305 and 310.
Figure 4:
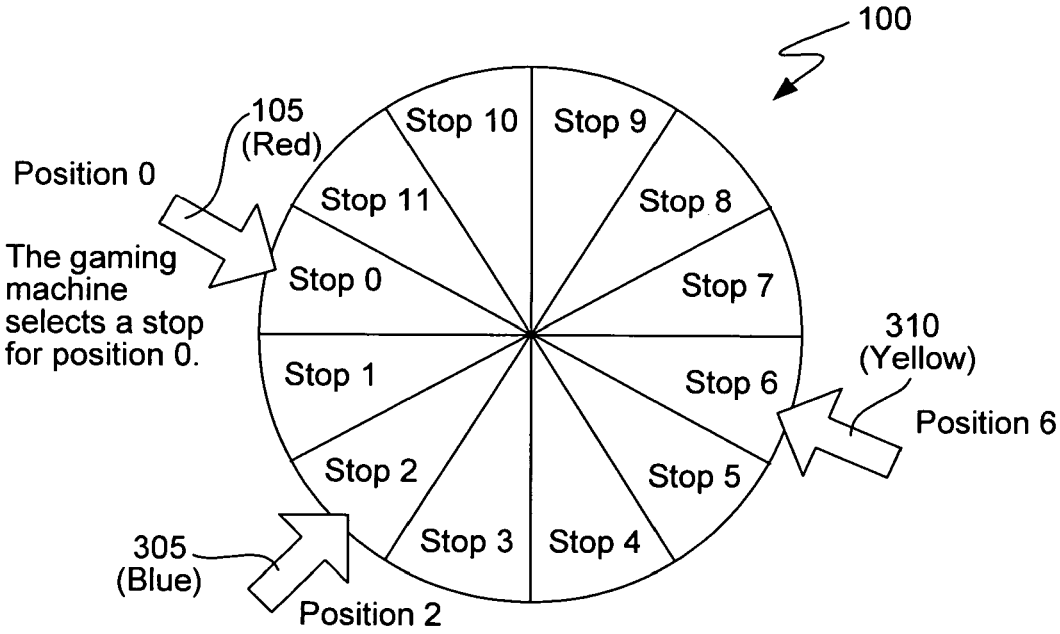
FIG. 4 (PRIOR ART)
FIG. 4 shows an alternative illustration of conventional Wheel of Fortune® game 100 with additional pointers 305 and 310.
Figure 5:
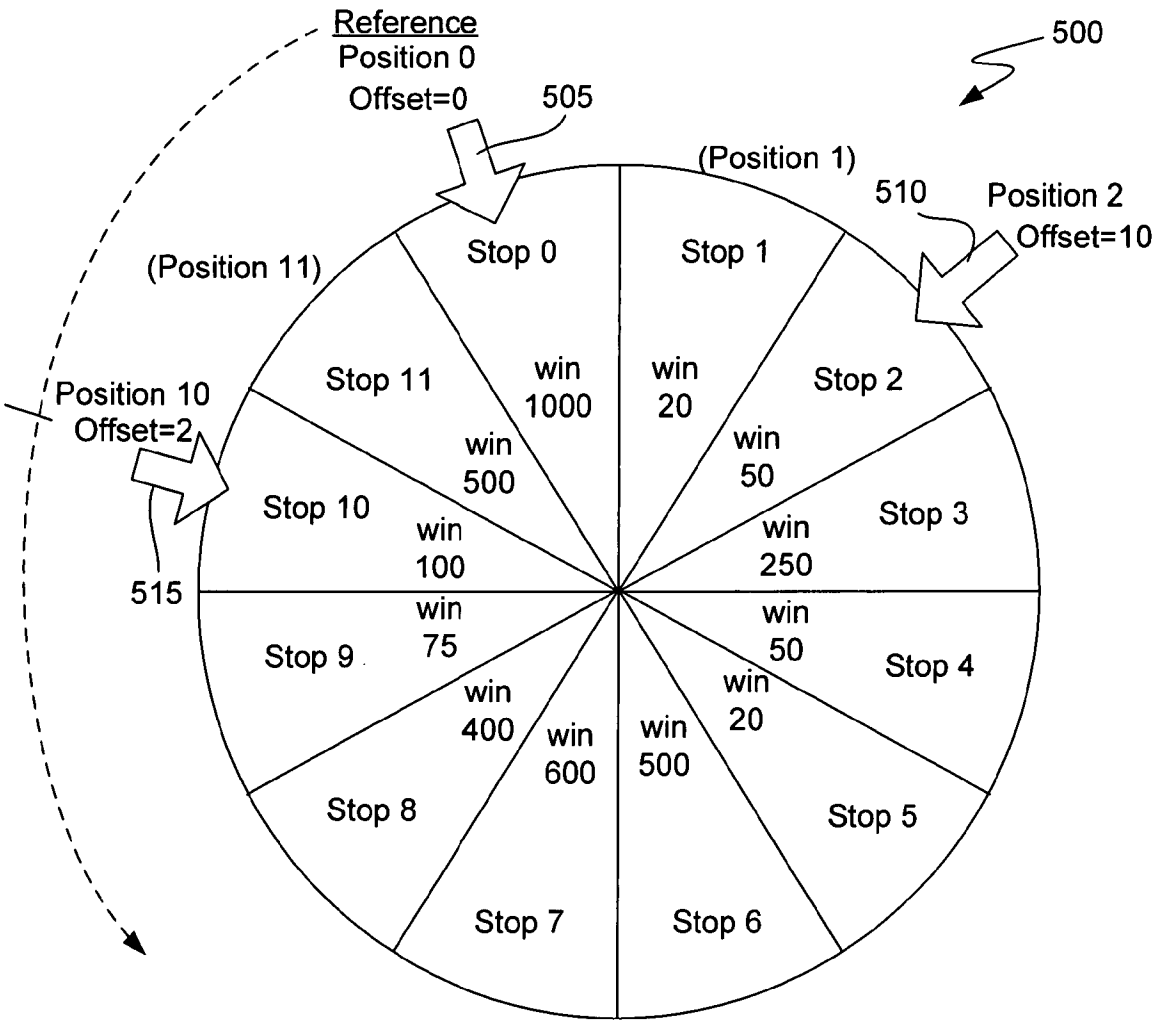
FIG. 5 shows an illustration of a Wheel of Fortune® game 500 constructed according to one embodiment of the present invention.

FIG. 5 shows a game of chance in the form of a Wheel of Fortunes® game, implemented according to one embodiment of the present invention. In FIG. 5, a plurality of outcomes is defined in the form of stops disposed about the wheel, similar to the stops shown in FIGS. 1 and 3. As with the wheels in FIGS. 1 and 3, each stop has an associated award amount. For instance, in FIG. 5, stop 0 has an award amount of $1,000, stop 1 has an award amount of $20, stop 2 has an award amount of $50, and so forth. Those skilled in the art should appreciate that in an alternative embodiment, the outcomes of the wheel 500 are the award amounts themselves rather than the stops associated with those award amounts.

In FIG. 5, a red pointer 505 points at stop 0, a yellow pointer 510 points at stop 2, and a blue pointer 515 points at stop 10. The pointers in FIG. 5 have fixed positions about the wheel, and these positions remain fixed as the wheel is spun. The positions are spaced apart from one another by a predetermined number of stops along the wheel. In the embodiment of FIG. 5, the positions are numbered with respect to a reference position. In this example, the red pointer 505 is at the reference position, designated as position 0. That is, position "0" refers to an offset of 0 from the reference pointer. Those skilled in the art will understand that the numbering of positions and corresponding offsets along the wheel can be set in clockwise or counterclockwise directions, as desired for the particular implementation. In one numbering scheme, the yellow pointer is situated two stops to the right or clockwise along the wheel from red pointer 505. Thus, in this example, yellow pointer 510 is at position 2 along the wheel. Applying the same numbering scheme, blue pointer 515 is at position 10 along the wheel, or 10 stops around the wheel in the clockwise direction from the reference position or red pointer 505. When offsets are numbered in the counterclockwise direction, blue pointer 515 has an offset value of 2, or 2 stops in the counterclockwise direction from the reference position, and yellow pointer 510 has an offset value of 10. The significance of the positions of the various pointers in FIG. 5 is explained below.

A pay table with weights assigned to the various stops in FIG. 5 can be generated, similar to Table 4 described above. As with Table 4, the average payouts for the various pointers would be different from one another, without further processing. Again, this discrepancy arises because the weights are associated with stops along the wheel for only a single pointer, or reference position. Therefore, without further processing, the excitement associated with selecting one of the three pointers would be lost as soon as the player identifies the pointer having the highest winnings.

A method for compensating for player choice in a game of chance, performed in accordance with one embodiment of the present invention, is described below. The method provides for moving the reference position or position 0 in accordance with the player selection of a pointer, so that the selected pointer is always at the reference position. In one embodiment, this movement is accomplished by adding the offset value of the selected pointer to the position number of the selected pointer, modulo the number of stops. In another embodiment, rather than adding an offset to the position of the selected pointer, a separate pay table is maintained for each pointer, and the pay table associated with the selected pointer is applied responsive to the selection. The structure of the pay table, that is, assignment of weights and payouts to the various stops, is such that the expected outcomes and payouts are the same, regardless of which pointer is chosen. For example, the numbers in the various pay tables associated with the respective pointers can be set so that the effect is the same as adding offset values associated with the pointers to move the selected pointer to the reference position before the pay table is applied. Returning to Table 4, the effect is the same as shifting the payout entries in the blue pointer payout and the yellow pointer payout columns by the respective offset values of the blue and yellow pointers so that the payout entries are the same as the red pointer payout entries for each possible stop. In this way, the average payout computation is the same, regardless of the pointer selected.

Table 5 shows the effect of moving the reference position according to the offset values associated with the respective blue and yellow pointers.

TABLE 5

| Machine Selected Stop | Weight | Red Pointer Payout | Payout Weight at Red Pointer | Blue Pointer Payout | Payout Weight at Blue Pointer | Yellow Pointer Payout | Payout Weight at Yellow Pointer |
|---|---|---|---|---|---|---|---|
| 0 | 9 | 30 | 270 | 30 | 270 | 30 | 270 |
| 1 | 14 | 20 | 280 | 20 | 280 | 20 | 280 |
| 2 | 8 | 65 | 520 | 65 | 520 | 65 | 520 |
| 3 | 10 | 25 | 250 | 25 | 250 | 25 | 250 |
| 4 | 2 | 500 | 1000 | 500 | 1000 | 500 | 1000 |
| 5 | 11 | 50 | 550 | 50 | 550 | 50 | 550 |
| 6 | 10 | 40 | 400 | 40 | 400 | 40 | 400 |
| 7 | 9 | 75 | 675 | 75 | 675 | 75 | 675 |
| 8 | 10 | 15 | 150 | 15 | 150 | 15 | 150 |
| 9 | 10 | 50 | 500 | 50 | 500 | 50 | 500 |
| 10 | 2 | 150 | 300 | 150 | 300 | 150 | 300 |
| 11 | 10 | 25 | 250 | 25 | 250 | 25 | 250 |
| Totals | 105 | | 5145 | | 5145 | | 5145 |
| | | Averages | 49 | | 49 | | 49 |

In Table 5 above, those skilled in the art should appreciate that stops 0-11 are explicitly defined in the "Stop" column, but they do not need to be. In one example, the stop is not explicitly stored, but is implied by the row or entry number. For instance, if the first row is determined as the output, stop 0 is selected, if the second row is chosen, stop 1 is selected, and so forth. In an alternative implementation to that defined by Table 5, the stops may all be equally probable. Generally, however, the stops have assigned weights, as shown in Table 5.

Figure 6:
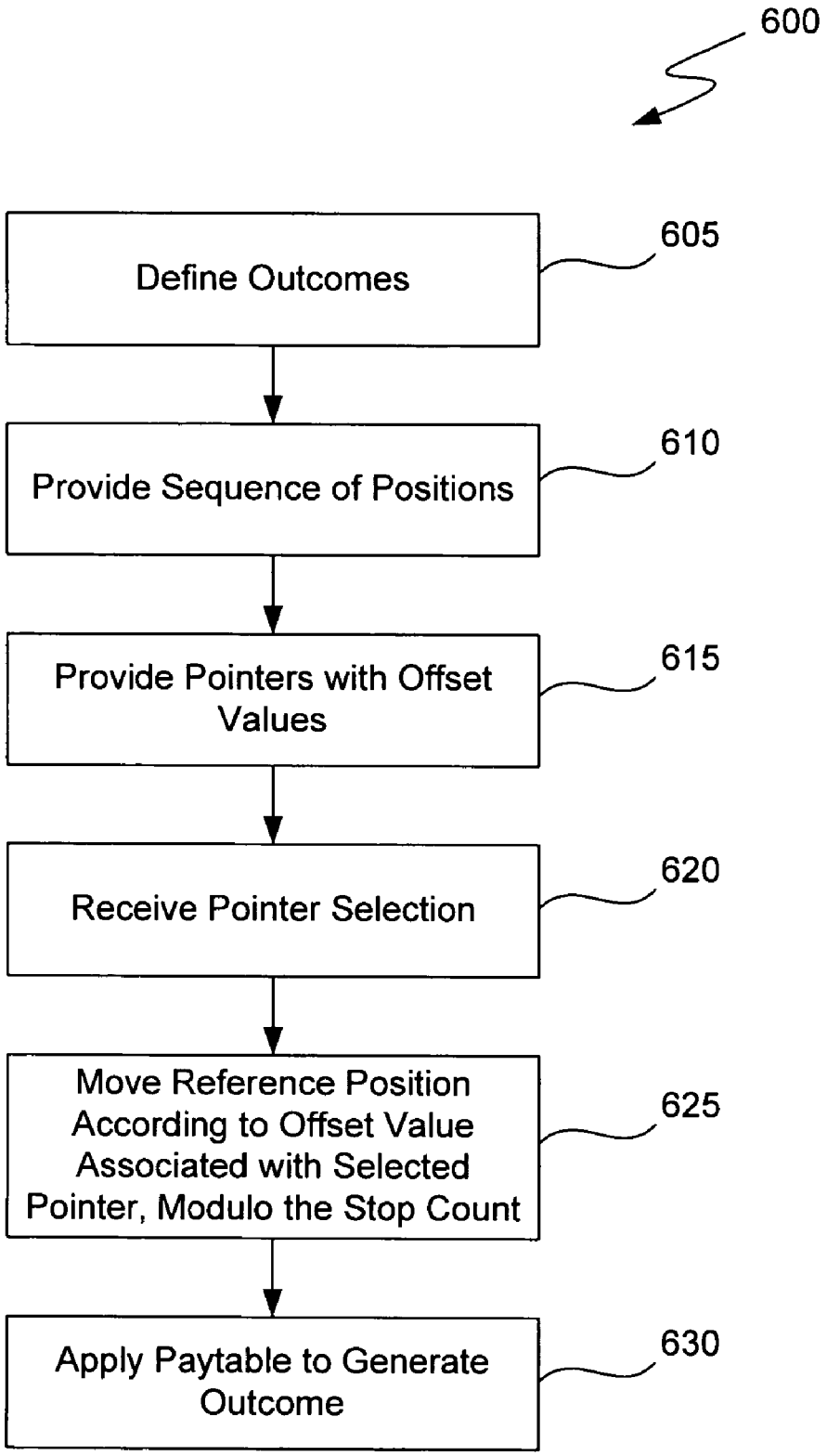
FIG. 6 shows a flow diagram of a method 600 for compensating for player choice in a game chance, performed in accordance with one embodiment of the present invention.

FIG. 6 shows a method for compensating for player choice in a game chance, performed in accordance with one embodiment of the present invention. In step 605, a plurality of outcomes for the game of chance is defined. For example, these outcomes can be award amounts or stops as described above with respect to the Wheel of Fortune® game. In another embodiment, the outcomes are numbers or symbols having significance in the particular game of chance being implemented. That is, the outcomes can be defined as needed for various games, in addition to wheel structures as described above.

In step 610 of FIG. 6, a sequence of positions are provided. In the Wheel of Fortune® embodiment described above with respect to FIG. 5, these positions are disposed about the wheel and remain fixed as the wheel is spun. In step 615, a plurality of pointers is established and situated at positions as defined in step 610. In the Wheel of Fortune® game of FIG. 5, for example, the blue pointer 515 is situated at position 10, the red pointer 505 at position 0, and the yellow pointer 510 at position 2. These pointers also remain in place when the wheel is spun, that is, when an output in the form of a stop or payout is determined and provided at the reference position, position 0. As shown in FIG. 5, the pointers have offsets with respect to the reference position. In this embodiment, the red pointer is situated at the reference position. The blue pointer 515 is at position 10, having an offset of 2 in the counterclockwise direction along the wheel. The yellow pointer 510 is situated at position 2, having an offset value of 10 again in a counterclockwise direction of the numbering scheme employed in this embodiment. As one can see in FIG. 5, the position numbers are assigned in the clockwise direction, and the offset values are assigned in a counterclockwise direction. Those skilled in the art will appreciate that the directions for these numbering schemes can be reversed, made the same, or replaced with other numbering schemes as desired for the particular embodiment.

In step 620 of FIG. 6, game play begins. The player selects one of the pointers, for instance, the blue pointer 515 in FIG. 5. In another game, the pointer is not selected by the player, but rather by a random number generator situated in the gaming machine or at a central computer with which the gaming machine communicates over a suitable data network, as described in one embodiment below. The random number generator generates a random number using deterministic or non-deterministic methods, as desired for the particular implementation. In step 625, after the pointer is selected, the reference position is moved according to the offset value associated with the selected pointer so that the selected pointer points at the reference position. For example, in FIG. 5 above, the blue pointer 515 is selected, having an offset value of 2. The reference position originally at position 0 with the red pointer 505 is moved by the offset value of 2 so that the reference position is aligned with blue pointer 515. Then, when the pay table is applied and a number is generated to select one of the possible outcomes in the game according to the associated weights or predefined probabilities established in the pay table, the generated outcome in step 630 for the reference position is provided at the blue pointer 515. The outcome is the same as if the player had selected the red pointer 505 at position 0. In step 625, movement of the reference position includes a modulo operation when the offset value is greater than the stop count, or total number of stops (12 in this example). A Bingo embodiment, described below, illustrates the modulo operation.

Applying the technique described above, the game outcome will be the same, regardless of the pointer selected. This is because the generated outcome is output for the reference position, which will always be aligned with the selected pointer after the reference position is moved according to the offset value associated with the selected pointer. In FIG. 5, for example, when the player chooses the red pointer in a Wheel of Fortune® spin, the red pointer is already at position 0, the reference position, and has an offset value of 0. Thus, the reference position is not moved and all probabilities in the pay table are based on the symbols or stops being output at the red pointer. By the same token, when the player chooses the yellow pointer 510, at position 2 and having an offset value of 10, the reference position is moved by that offset value of 10 so that the yellow pointer is situated at the reference position.

In another embodiment, rather than shifting the reference position according to the pointer selected, a separate pay table can be established for each pointer so that the average payouts are the same regardless of the pointer selected. In some implementations, these pay tables will be constructed so that the payouts and weights in one pay table are shifted with respect to the other pay tables according to the offset values of the pointers associated with those pay tables. In this way, the net effect of selection and application of a particular pay table is the same as applying the offset value of the pointer associated with that pay table, as described above in FIGS. 5 and 6. This embodiment with a plurality of pay tables can be beneficial in implementations where a game machine is already configured to read and interpret more than one pay table. The desired pay tables can be constructed and assigned before game play begins.

Figure 7:
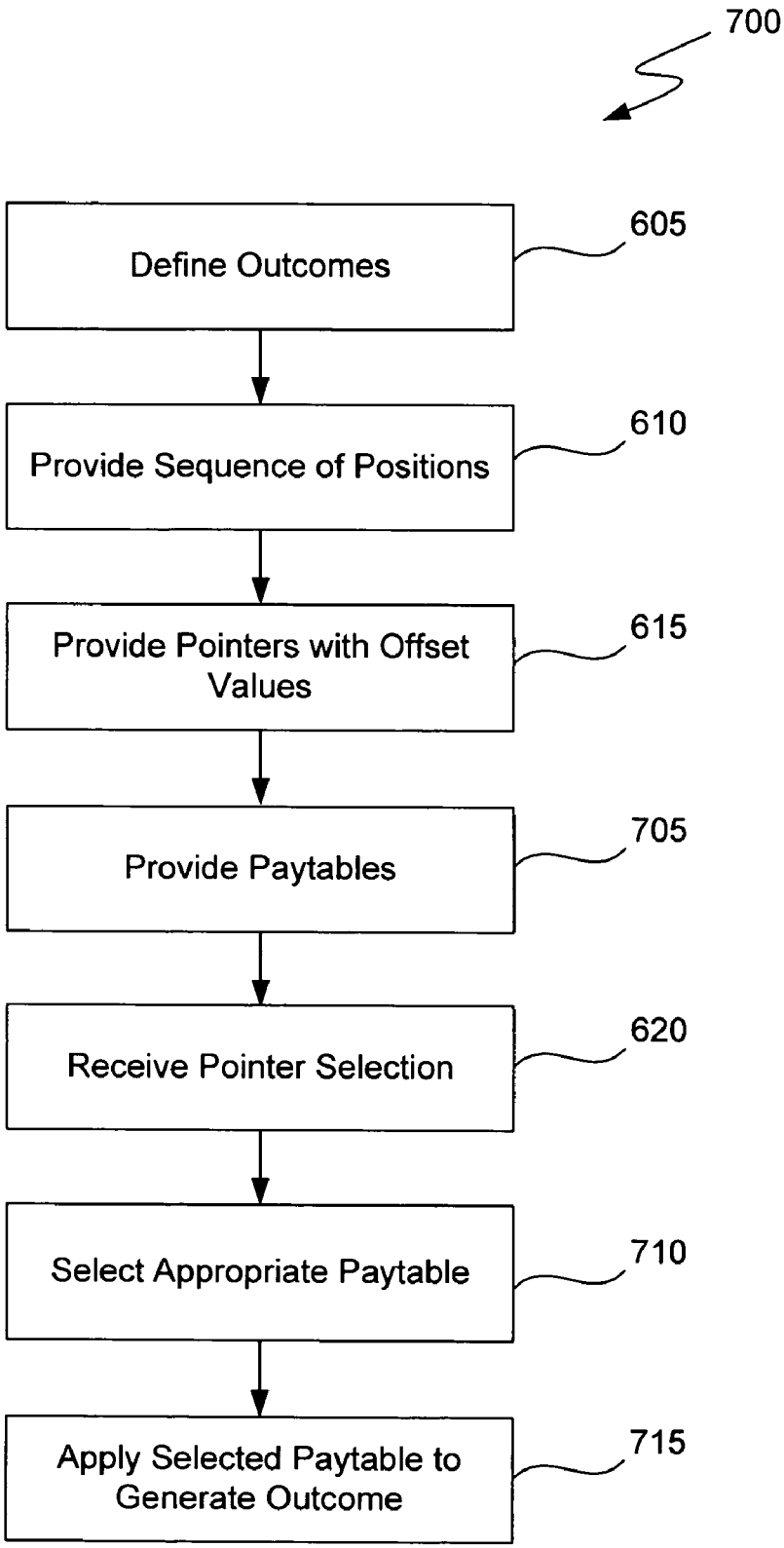
FIG. 7 shows a flow diagram of a method 700 for compensating for player choice in a game chance, performed in accordance with one embodiment of the present invention.

In FIG. 7, a method for compensating for a player choice in a game of chance, performed in accordance with another embodiment of the present invention, is shown. In the method 700 of FIG. 7, a number of the steps in the method correspond to steps described above with respect to FIG. 6. These include defining a plurality of outcomes, in step 605, providing a sequence of positions, in step 610, providing pointers with offset values, in step 615 and receiving a pointer selection in step 620. However, in FIG. 7, rather than moving the reference position, in step 705, a plurality of pay tables is defined as described above. For instance, with reference to FIG. 5, a separate pay table can be defined for each pointer, such as a blue pay table associated with the blue pointer, a red pay table associated with the red pointer, and a yellow pay table associated with the yellow pointer. In step 620, responsive to the player, gaming machine, or some other device selecting one of the pointers, the pay table associated with the selected pointer, as established in step 705, is selected. In step 715, the selected pay table from step 710 is applied to generate an outcome for the game. In one example, a random number is generated, selecting one of the outcomes in the selected pay table according to the weight or predefined probability for the selected one outcome. The selected outcome is then output at the position of the selected pointer.

Figure 8:
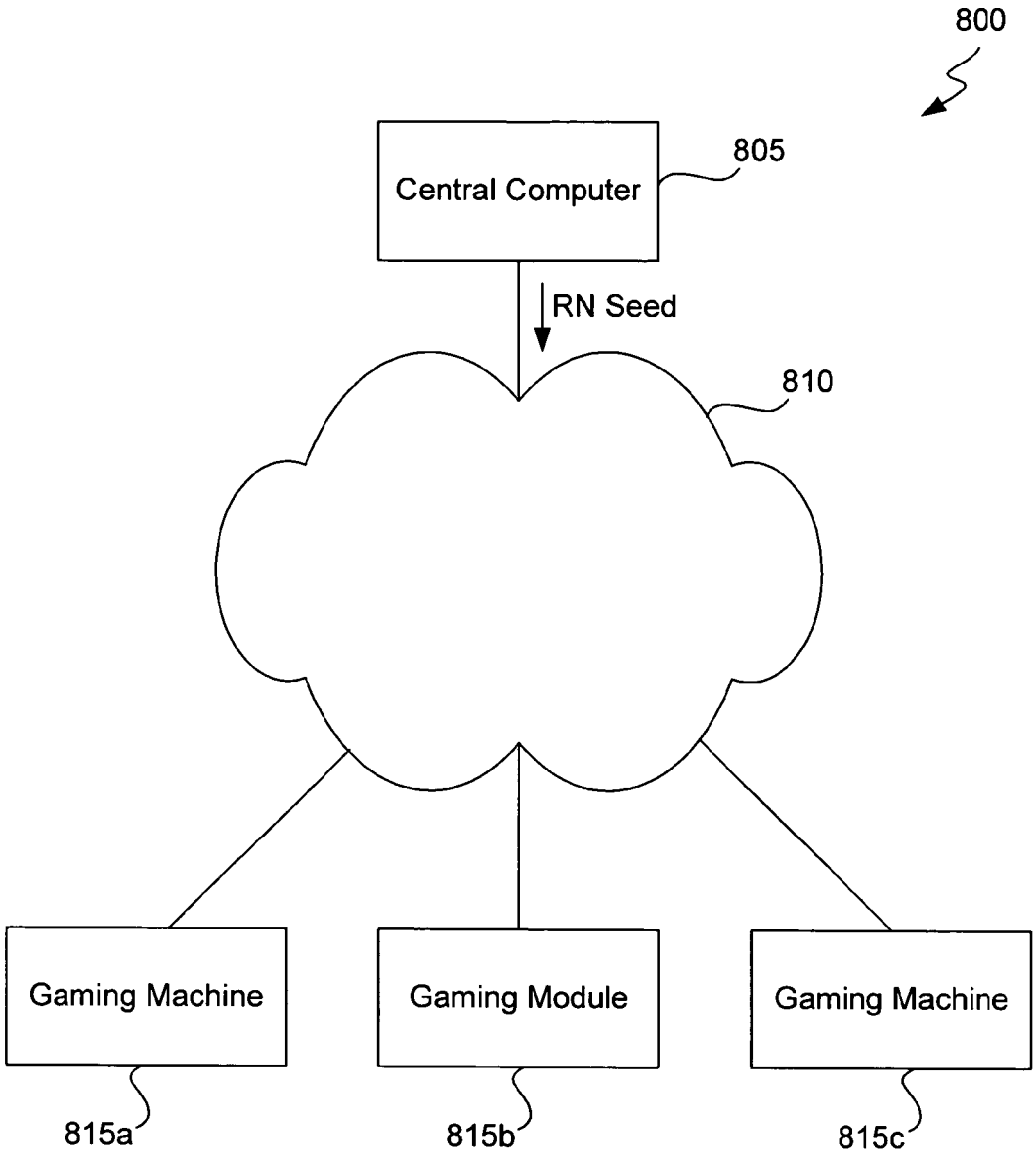
FIG. 8 shows a block diagram of a Central Determination system 800 for compensating for a player choice in a game of chance, constructed according to one embodiment of the present invention.

FIG. 8 shows a central determination system 800 for compensating for a player choice in a game of chance using a reel offset or other offset value, according to one embodiment of the present invention. Some embodiments of the present invention are implemented in central determination systems such as system 800 and other central determination systems such as those described in U.S. Pat. No. 6,533,664, titled "Gaming System with Individualized Centrally Generated Random Number Generator Seeds," which is hereby incorporated by reference in its entirety.

In FIG. 8, a central computer 805 is in communication with a data network 810. Also in communication with data network 810 is a plurality of gaming machines 815*a*-815*c*. The central computer 805 and gaming machines 815*a*-815*c* communicate with one another over the data network 810. The central computer 805 is configured to generate outcomes or seeds. These seeds are processed and used by individual gaming machines 815*a*-815*c* to control the games played on those machines 815*a*-815*c*. In one embodiment, the seed generated by central computer 805 is deterministic and input to a random number generator (RNG) to generate random numbers. The RNG can be situated on the particular gaming machine or at the central computer 805, depending on the desired implementation. These random numbers can be used to index pay tables as described above with reference to Table 2 to determine stops or award amounts. In this Class II embodiment, the gaming machine need only draw random numbers as it would in a Class III configuration, to produce the desired predetermined result.

In one embodiment of the present invention, a Bingo game is played on gaming machine 815*a* in central determination system 800, as shown in FIG. 8. To offer more entertainment value to the player, the outcome of the bingo game is displayed on the gaming machine 815*a* with an alternate representation, for example as a slot game. In this embodiment, the outcome of the Bingo game is predetermined. As with the Wheel of Fortune® embodiment described above, it is desirable that the predetermined outcome not be affected by player choice.

Accordingly, a reel offset pay table is constructed to compensate for player choice. In one example, as shown below in Table 6, one column specifies an offset value in the form of a reel offset, to use for each position selected by a player. In this embodiment, the position chosen by the player, or "player chosen position," is one type of "pointer" as used herein, functioning in essentially the same manner as the pointer described above in the Wheel of Fortunes® embodiment. Preferably, the reel offset pay table further includes the weight and payout of each reel stop (not shown), similar to Table 5 above.

TABLE 6

| Player Chosen Position | Reel Offset (Offset Value) |
|---|---|
| 0 | 0 |
| 2 | 10 |
| 6 | 6 |

In this Bingo embodiment, to select a reel, the gaming machine 815*a* follows the steps described above for generating a random number and using the weights defined in the pay table to determine a reel stop as an outcome. Once the stop has been determined, the reel offset pay table of Table 6 is indexed to identify the offset value associated with the position chosen by the player. For example, player chosen position 2 has an associated reel offset of 10. This offset value of 10 is added to the determined stop, modulo the stop count, that is, total number of reel stops, and the result is then provided as the outcome for the Bingo game.

In one Bingo game example, the player chooses position 2, and the gaming machine randomly determines that the selected stop is 7. The gaming machine then indexes Table 6 with the player chosen position of 2 and finds that the reel offset for position 2 is 10. This offset value of 10 is added to stop 7, producing 17. There are 12 stops on the reel (i.e., the stop count is 12), so the final result will be 17 mod 12, which is 5. This stop 5 will then be the reference position, or location for the game output when the pay table is applied. The originally determined stop, 7, appears at the player's selected position 2.

Again, as with the Wheel of Fortune® embodiment described above, some gaming machines and systems are already configured to read and interpret pay tables. In this context, it may be beneficial to express the reel offset in the form of a separate pay table for each possible player chosen position. The following Table 7 shows one example of this implementation:

TABLE 7

| Stop for Player Chosen Position 0 | Stop for Player Chosen Position 2 | Stop for Player Chosen Position 6 | Payout | Weight | Range |
|---|---|---|---|---|---|
| 0 | 10 | 6 | 30 | 9 | 0-8 |
| 1 | 11 | 7 | 20 | 14 | 9-22 |

TABLE 7-continued

| Stop for Player Chosen Position 0 | Stop for Player Chosen Position 2 | Stop for Player Chosen Position 6 | Payout | Weight | Range |
|---|---|---|---|---|---|
| 2 | 0 | 8 | 65 | 8 | 23-30 |
| 3 | 1 | 9 | 25 | 10 | 31-40 |
| 4 | 2 | 10 | 500 | 2 | 41-42 |
| 5 | 3 | 11 | 50 | 11 | 43-53 |
| 6 | 4 | 0 | 40 | 10 | 54-63 |
| 7 | 5 | 1 | 75 | 9 | 64-72 |
| 8 | 6 | 2 | 15 | 10 | 73-82 |
| 9 | 7 | 3 | 50 | 10 | 83-92 |
| 10 | 8 | 4 | 150 | 2 | 93-94 |
| 11 | 9 | 5 | 25 | 10 | 95-104 |

Those skilled in the art will appreciate that Table 7 is an expression of three separate pay tables, one for each player chosen position of 0, 2, or 6, in the form of one table. In an alternative embodiment, the pay table of Table 7 is implemented as 3 separate tables, one for each player choice. Such an alternative embodiment provides the benefit of allowing the game to operate in the same manner as it would operate in a Class III, with the exception that instead of reading the stop from one pay table column, the stop is read from one of three columns (using the implementation of Table 7) or from one of 3 possible pay tables (using the alternative embodiment).

Figure 9:
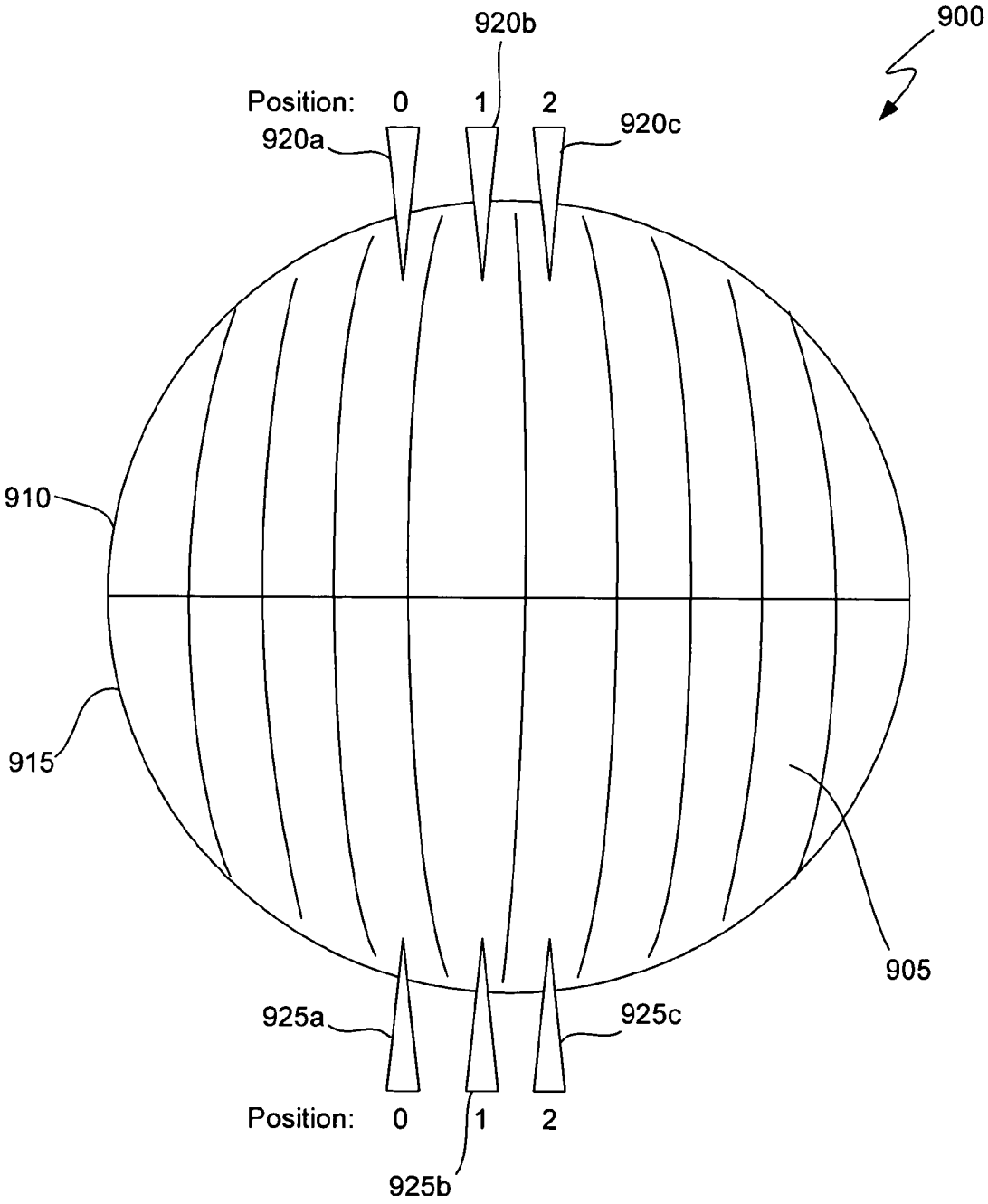
FIG. 9 shows a front view of a Death Star™ game 900 constructed according to one embodiment of the present invention.

FIG. 9 shows a Star Wars Death Star™ Bonus game 900 constructed according to one embodiment of the present invention. The game 900 features a sphere 905 with an upper section 910 and a lower section 915. Each section is divided into portions with award amounts, as shown in FIG. 9. Three upper pointers 920*a*, 920*b* and 920*c* are disposed at positions 0, 1 and 2 along upper section 910. Three lower pointers 925*a*, 925*b* and 925*c* are disposed at positions 0, 1 and 2 along lower section 915. For game play, the player selects one of the upper pointers 920*a-c* and one of the lower pointers 925*a-c* before the sphere 905 is spun. When the sphere 905 finishes spinning, the award amounts pointed to by the selected upper and lower pointers are summed and awarded to the player.

In FIG. 9, as with the Wheel of Fortune® game described above, the positions at which the pointers are situated remain fixed while the award amounts spin with the sphere. The positions of the pointers can be spaced apart from one another along the stops as desired. For example, the upper level pointers 920*a-c* can be situated at positions 0, 4, and 8. Viewing sphere 905 from the upper pole or lower pole, the positions are numbered in sequence in a clockwise or counterclockwise direction moving away from the reference position, position 0. In this example, pointers 920*a* and 925*a* are situated at the reference position. Pointers 920*b* and 925*b* at position 1 have an offset value of 1 with respect to the reference position, and pointers 920*c* and 925*c* at position 2 have an offset value of 2 with respect to the reference position. The direction about the sphere for numbering of positions and offset values can be set as desired, similar to the Wheel of Fortune® game above.

During play of the Death Star™ Bonus game, the gaming machine randomly generates a single stop or associated award amount and spins the sphere 905 so that the generated stop is provided as an outcome at the reference position, in this example, position 0 with pointers 920*a* and 925*a*. The player is awarded the sum of the award amounts pointed to by the upper and lower pointers 920*a* and 925*a*.

Table 8 shows one example of a pay table constructed for the Death Star™ Bonus game:

TABLE 8

| Stop | Weight | Upper Section Payout | Lower Section Payout |
|---|---|---|---|
| 0 | 1 | 50 | 14 |
| 1 | 1 | 200 | 30 |
| 2 | 1 | 200 | 4 |
| 3 | 1 | 10 | 20 |
| 4 | 1 | 30 | 6 |
| 5 | 1 | 10 | 120 |
| 6 | 1 | 15 | 5 |
| 7 | 1 | 80 | 40 |
| 8 | 1 | 20 | 9 |
| 9 | 1 | 10 | 50 |
| 10 | 1 | 100 | 4 |
| 11 | 1 | 200 | 18 |
| 12 | 1 | 200 | 12 |
| 13 | 1 | 2 | 40 |
| 14 | 1 | 80 | 15 |
| 15 | 1 | 30 | 20 |
| 16 | 1 | 16 | 6 |
| 17 | 1 | 8 | 30 |
| 18 | 1 | 100 | 4 |

In the example of Table 8, because the weights are all 1, the second column may be omitted when the pay table is constructed. With equal weights of 1, the stops are equally probable. Thus, in one implementation, outcome determination can be simplified to generating a single random number in the range 0 to 18, with the generated number representing the determined stop.

Applying the method 600 of FIG. 6 above, one example of the application of Table 8 is as follows. A player selects lower pointer 925*a* at position 0. When the gaming machine determines the outcome as stop 2, then the offset value of 0 associated with lower pointer 925*a* is applied, the reference position remains at position 0, and the player gets the value associated with stop 2, that is, 4 credits. If the player had selected the lower pointer 925*b* at position 1, rather than pointer 925*a* at position 0, the associated offset value of 1 would be applied to move the reference position from position 0 to position 1, and the same 4 credits amount associated with stop 2 would be awarded at pointer 925*b*.

In Table 8, because all of the stops have equal weight, the stops have the same probability of occurring at any position. This means that the average values for the lower pointers 925*a-c* are the same, regardless of the particular lower pointer chosen by the player. The same is true for the upper pointer. The average game outcomes should also be the same. The volatility, however, will be different, since award amounts summed to make the total award for the player will depend on the selection of both an upper pointer and lower pointer. Table 9 shows award amounts for determined stops, for all combinations of upper and lower pointers as selected by the player. In Table 9, the average award amounts for each combination of player choices are the same, but minimums and maximums differ. Lower minimums and higher maximums produce higher volatility.

TABLE 9

| Machine Determined | Player Selected Upper Position | | | | | | | | |
|---|---|---|---|---|---|---|---|---|---|
| | 0 | 0 | 0 | 1 | 1 | 1 | 2 | 2 | 2 |
| | Player Selected Lower Position | | | | | | | | |
| Stop | 0 | 1 | 2 | 0 | 1 | 2 | 0 | 1 | 2 |
| 0 | 64 | 80 | 54 | 214 | 230 | 204 | 214 | 230 | 204 |
| 1 | 230 | 204 | 220 | 230 | 204 | 220 | 40 | 14 | 30 |
| 2 | 204 | 220 | 206 | 14 | 30 | 16 | 34 | 50 | 36 |
| 3 | 30 | 16 | 130 | 50 | 36 | 150 | 30 | 16 | 130 |
| 4 | 36 | 150 | 35 | 16 | 130 | 15 | 21 | 135 | 20 |
| 5 | 130 | 15 | 50 | 135 | 20 | 55 | 200 | 85 | 120 |
| 6 | 20 | 55 | 24 | 85 | 120 | 89 | 25 | 60 | 29 |
| 7 | 120 | 89 | 130 | 60 | 29 | 70 | 50 | 19 | 60 |
| 8 | 29 | 70 | 24 | 19 | 60 | 14 | 109 | 150 | 104 |
| 9 | 60 | 14 | 28 | 150 | 104 | 118 | 250 | 204 | 218 |
| 10 | 104 | 118 | 112 | 204 | 218 | 212 | 204 | 218 | 212 |
| 11 | 218 | 212 | 240 | 218 | 212 | 240 | 20 | 14 | 42 |
| 12 | 212 | 240 | 215 | 14 | 42 | 17 | 92 | 120 | 95 |
| 13 | 42 | 17 | 22 | 120 | 95 | 100 | 70 | 45 | 50 |
| 14 | 95 | 100 | 86 | 45 | 50 | 36 | 31 | 36 | 22 |
| 15 | 50 | 36 | 60 | 36 | 22 | 46 | 28 | 14 | 38 |
| 16 | 22 | 46 | 20 | 14 | 38 | 12 | 106 | 130 | 104 |
| 17 | 38 | 12 | 208 | 130 | 104 | 300 | 40 | 14 | 210 |
| 18 | 104 | 300 | 114 | 14 | 210 | 24 | 54 | 250 | 64 |
| 19 | 210 | 24 | 40 | 250 | 64 | 80 | 400 | 214 | 230 |
| Average | 100.9 | 100.9 | 100.9 | 100.9 | 100.9 | 100.9 | 100.9 | 100.9 | 100.9 |
| Minimum | 20 | 12 | 20 | 14 | 20 | 12 | 20 | 14 | 20 |
| Maximum | 230 | 300 | 240 | 250 | 230 | 300 | 400 | 250 | 230 |

Embodiments of the present invention provide for establishing the same volatility for all of the combinations of player selected upper and lower positions, such as those shown in Table 9. In addition, the pay table can be constructed to produce a predetermined outcome regardless of the player choice. In one implementation, the award amounts are arranged such that, regardless of the player choice, the same 20 payouts are possible. This arrangement can be achieved experimentally, by trying values until a solution is found, either by hand or by use of a computer program. Tables 10a and 10b provide one example of such an arranged pay table. In Table 10a, when stored in a computer memory or other suitable storage medium, the Table could include only columns 3 and 4. Column 1 could be implied by the row or table entry number, and column 2 could be omitted since all of the stops are equally probable. In Table 10b, columns 3-11 demonstrate that the same payouts are possible regardless of player choice.

TABLE 10a

| Stop | Weight | Upper Section Payout | Lower Section Payout |
|---|---|---|---|
| 0 | 1 | 25 | 15 |
| 1 | 1 | 200 | 5 |

TABLE 10a-continued

| Stop | Weight | Upper Section Payout | Lower Section Payout |
|---|---|---|---|
| 2 | 1 | 200 | 40 |
| 3 | 1 | 40 | 120 |
| 4 | 1 | 40 | 15 |
| 5 | 1 | 80 | 5 |
| 6 | 1 | 80 | 40 |
| 7 | 1 | 20 | 120 |
| 8 | 1 | 20 | 15 |
| 9 | 1 | 25 | 5 |
| 10 | 1 | 25 | 40 |
| 11 | 1 | 200 | 120 |
| 12 | 1 | 200 | 15 |
| 13 | 1 | 40 | 5 |
| 14 | 1 | 40 | 40 |
| 15 | 1 | 80 | 120 |
| 16 | 1 | 80 | 15 |
| 17 | 1 | 20 | 5 |
| 18 | 1 | 20 | 40 |
| 19 | 1 | 25 | 120 |

TABLE 10b

| | Player Selected Upper Position | | | | | | | | |
|---|---|---|---|---|---|---|---|---|---|
| | 0 | 0 | 0 | 1 | 1 | 1 | 2 | 2 | 2 |
| | Player Selected Lower Position | | | | | | | | |
| Stop | 0 | 1 | 2 | 0 | 1 | 2 | 0 | 1 | 2 |
| 0 | 40 | 30 | 65 | 215 | 205 | 240 | 215 | 205 | 240 |
| 1 | 205 | 240 | 320 | 205 | 240 | 320 | 45 | 80 | 160 |
| 2 | 240 | 320 | 215 | 80 | 160 | 55 | 80 | 160 | 55 |
| 3 | 160 | 55 | 45 | 160 | 55 | 45 | 200 | 95 | 85 |
| 4 | 55 | 45 | 80 | 95 | 85 | 120 | 95 | 85 | 120 |
| 5 | 85 | 120 | 200 | 85 | 120 | 200 | 25 | 60 | 140 |
| 6 | 120 | 200 | 95 | 60 | 140 | 35 | 60 | 140 | 35 |
| 7 | 140 | 35 | 25 | 140 | 35 | 25 | 145 | 40 | 30 |
| 8 | 35 | 25 | 60 | 40 | 30 | 65 | 40 | 30 | 65 |
| 9 | 30 | 65 | 145 | 30 | 65 | 145 | 205 | 240 | 320 |
| 10 | 65 | 145 | 40 | 240 | 320 | 215 | 240 | 320 | 215 |
| 11 | 320 | 215 | 205 | 320 | 215 | 205 | 160 | 55 | 45 |
| 12 | 215 | 205 | 240 | 55 | 45 | 80 | 55 | 45 | 80 |
| 13 | 45 | 80 | 160 | 45 | 80 | 160 | 85 | 120 | 200 |
| 14 | 80 | 160 | 55 | 120 | 200 | 95 | 120 | 200 | 95 |
| 15 | 200 | 95 | 85 | 200 | 95 | 85 | 140 | 35 | 25 |
| 16 | 95 | 85 | 120 | 35 | 25 | 60 | 35 | 25 | 60 |
| 17 | 25 | 60 | 140 | 25 | 60 | 140 | 30 | 65 | 145 |
| 18 | 60 | 140 | 35 | 65 | 145 | 40 | 65 | 145 | 40 |
| 19 | 145 | 40 | 30 | 145 | 40 | 30 | 320 | 215 | 205 |
| Average | 118 | 118 | 118 | 118 | 118 | 118 | 118 | 118 | 118 |
| Min | 25 | 25 | 25 | 25 | 25 | 25 | 25 | 25 | 25 |
| Max | 320 | 320 | 320 | 320 | 320 | 320 | 320 | 320 | 320 |

In the pay table defined by Tables 10a and 10b, regardless of the player selection, the same 20 stops or award amounts are possible. In a Class III system, the player's pointer selection may still affect the outcome, but the volatility and average payout will remain the same.

In an alternative embodiment to the pay table arrangement of Tables 10a and 10b, the award amounts are arranged as shown in Tables 10c and 10d.

TABLE 10c

| Stop | Weight | Upper Section Payout | Lower Section Payout |
|---|---|---|---|
| 0 | 1 | 8 | 30 |
| 1 | 1 | 200 | 4 |
| 2 | 1 | 200 | 50 |
| 3 | 1 | 8 | 10 |
| 4 | 1 | 100 | 30 |
| 5 | 1 | 20 | 10 |
| 6 | 1 | 15 | 30 |
| 7 | 1 | 8 | 4 |
| 8 | 1 | 20 | 50 |
| 9 | 1 | 100 | 4 |
| 10 | 1 | 15 | 50 |
| 11 | 1 | 200 | 10 |
| 12 | 1 | 200 | 30 |
| 13 | 1 | 15 | 4 |
| 14 | 1 | 100 | 50 |
| 15 | 1 | 20 | 4 |
| 16 | 1 | 8 | 50 |
| 17 | 1 | 15 | 10 |
| 18 | 1 | 20 | 30 |
| 19 | 1 | 100 | 10 |

The arrangement of award amounts in Tables 10c and 10d accomplishes the same goal as the arrangement of Tables 10a and 10b. One benefit of the arrangement in Tables 10c and 10d is that the outcomes appear more random to the player.

For Class II or Central Determination systems such as system 800 of FIG. 8, the arrangement of Tables 10a and 10b enables the use of offset values or reel stops to force a predetermined outcome, regardless of the player choice. For example, Table 11 below can be implemented to determine the stop, based on player selections. The determined stop can then be used to index the pay table defined in Tables 10a and 10b above to identify the award amount associated with that stop, given the player's selection of pointers.

TABLE 11

| | | | Player Selected Upper Position | | | | | | | | |
|---|---|---|---|---|---|---|---|---|---|---|---|
| | | | 0 | 0 | 0 | 1 | 1 | 1 | 2 | 2 | 2 |
| | | | Player Selected Lower Position | | | | | | | | |
| Upper Section Payout | Lower Section Payout | | 0 | 1 | 2 | 0 | 1 | 2 | 0 | 1 | 2 |
| 25 | 15 | Stop | 0 | 19 | 10 | 8 | 19 | 18 | 8 | 7 | 18 |
| 200 | 5 | | 1 | 12 | 11 | 1 | 0 | 11 | 9 | 0 | 19 |
| 200 | 40 | | 2 | 1 | 12 | 10 | 1 | 0 | 10 | 9 | 0 |
| 40 | 120 | | 3 | 14 | 13 | 3 | 2 | 13 | 11 | 2 | 1 |
| 40 | 15 | | 4 | 3 | 14 | 12 | 3 | 2 | 12 | 11 | 2 |
| 80 | 5 | | 5 | 16 | 15 | 5 | 4 | 15 | 13 | 4 | 3 |
| 80 | 40 | | 6 | 5 | 16 | 14 | 5 | 4 | 14 | 13 | 4 |
| 20 | 120 | | 7 | 18 | 17 | 7 | 6 | 17 | 15 | 6 | 5 |
| 20 | 15 | | 8 | 7 | 18 | 16 | 7 | 6 | 16 | 15 | 6 |
| 25 | 5 | | 9 | 0 | 19 | 9 | 8 | 19 | 17 | 8 | 7 |
| 25 | 40 | | 10 | 9 | 0 | 18 | 9 | 8 | 18 | 17 | 8 |
| 200 | 120 | | 11 | 2 | 1 | 11 | 10 | 1 | 19 | 10 | 9 |
| 200 | 15 | | 12 | 11 | 2 | 0 | 11 | 10 | 0 | 19 | 10 |
| 40 | 5 | | 13 | 4 | 3 | 13 | 12 | 3 | 1 | 12 | 11 |

TABLE 10d

| | | Player Selected Upper Position | | | | | | | | |
|---|---|---|---|---|---|---|---|---|---|---|
| | | 0 | 0 | 0 | 1 | 1 | 1 | 2 | 2 | 2 |
| | | Player Selected Lower Position | | | | | | | | |
| Stop | | 0 | 1 | 2 | 0 | 1 | 2 | 0 | 1 | 2 |
| 0 | Stop | 38 | 12 | 58 | 230 | 204 | 250 | 230 | 204 | 250 |
| 1 | | 204 | 250 | 210 | 204 | 250 | 210 | 12 | 58 | 18 |
| 2 | | 250 | 210 | 230 | 58 | 18 | 38 | 150 | 110 | 130 |
| 3 | | 18 | 38 | 18 | 110 | 130 | 110 | 30 | 50 | 30 |
| 4 | | 130 | 110 | 130 | 50 | 30 | 50 | 45 | 25 | 45 |
| 5 | | 30 | 50 | 24 | 25 | 45 | 19 | 18 | 38 | 12 |
| 6 | | 45 | 19 | 65 | 38 | 12 | 58 | 50 | 24 | 70 |
| 7 | | 12 | 58 | 12 | 24 | 70 | 24 | 104 | 150 | 104 |
| 8 | | 70 | 24 | 70 | 150 | 104 | 150 | 65 | 19 | 65 |
| 9 | | 104 | 150 | 110 | 19 | 65 | 25 | 204 | 250 | 210 |
| 10 | | 65 | 25 | 45 | 250 | 210 | 230 | 250 | 210 | 230 |
| 11 | | 210 | 230 | 204 | 210 | 230 | 204 | 25 | 45 | 19 |
| 12 | | 230 | 204 | 250 | 45 | 19 | 65 | 130 | 104 | 150 |
| 13 | | 19 | 65 | 19 | 104 | 150 | 104 | 24 | 70 | 24 |
| 14 | | 150 | 104 | 150 | 70 | 24 | 70 | 58 | 12 | 58 |
| 15 | | 24 | 70 | 30 | 12 | 58 | 18 | 19 | 65 | 25 |
| 16 | | 58 | 18 | 38 | 65 | 25 | 45 | 70 | 30 | 50 |
| 17 | | 25 | 45 | 25 | 30 | 50 | 30 | 110 | 130 | 110 |
| 18 | | 50 | 30 | 50 | 130 | 110 | 130 | 38 | 18 | 38 |
| 19 | | 110 | 130 | 104 | 18 | 38 | 12 | 210 | 230 | 204 |
| | Average | 92.10 | 92.10 | 92.10 | 92.10 | 92.10 | 92.10 | 92.10 | 92.10 | 92.10 |
| | Minimum | 12 | 12 | 12 | 12 | 12 | 12 | 12 | 12 | 12 |
| | Maximum | 250 | 250 | 250 | 250 | 250 | 250 | 250 | 250 | 250 |

TABLE 11-continued

| Upper Section Payout | Lower Section Payout | Player Selected Upper Position 0 | 0 | 0 | 1 | 1 | 1 | 2 | 2 | 2 |
|---|---|---|---|---|---|---|---|---|---|---|
| | | Player Selected Lower Position 0 | 1 | 2 | 0 | 1 | 2 | 0 | 1 | 2 |
| 40 | 40 | 14 | 13 | 4 | 2 | 13 | 12 | 2 | 1 | 12 |
| 80 | 120 | 15 | 6 | 5 | 15 | 14 | 5 | 3 | 14 | 13 |
| 80 | 15 | 16 | 15 | 6 | 4 | 15 | 14 | 4 | 3 | 14 |
| 20 | 5 | 17 | 8 | 7 | 17 | 16 | 7 | 5 | 16 | 15 |
| 20 | 40 | 18 | 17 | 8 | 6 | 17 | 16 | 6 | 5 | 16 |
| 25 | 120 | 19 | 10 | 9 | 19 | 18 | 9 | 7 | 18 | 17 |

To utilize the pay table of Table 11 for a Class II or Central Determination system, the machine would generate a random number as an index into the pay table according to the player's selections, similar to Table 7, to determine the stop. In one example, the machine determines entry or row 0 (upper section payout=25, lower section payout=15), as the outcome. In this example, the player selected upper pointer 920*a* at upper position 0 and lower pointer 925*a* at lower position 0. For this pointer combination, Table 11 indicates that the determined stop is 0 (first row, and the 0/0 column). Stop 0 at the 0/0 column is then accessed in Table 10b, identifying an award amount of 40. In another example, the machine determined entry or row is again 0, and the player selects upper pointer 920*b* at position 1 and lower pointer 925*c* at position 2. Accessing Table 11 at row 0 in the ½ column, the table indicates that the determined stop is 18. By again using the determined stop, 18, to access previous Table 10b, at the ½ column, Table 10b indicates an award amount of 40. Thus, the arrangement of numerical values in the tables ensures that the outcome determined by the gaming machine is used to access the correct stop to pay the same amount, regardless of the player's choice.

In an alternative embodiment to that described above with respect to Tables 10a, 10b and 11, the stops are weighted, and player choice does not affect the average payout or the volatility, or in the case of Class II and Central Determination, the actual outcome.

In yet another embodiment, a Wheel of Fortune® game is implemented in which the player is allowed to choose one pointer for one game play session, and then is able to choose additional pointers on the same wheel or reel for successive game play sessions. When the player chooses a subset of the total number of pointers, there are various combinations of pointers which can be selected. The pay tables are constructed, using the same techniques described above, so that the average payout is the same regardless of the subset of pointers selected.

Some games of the present invention can be implemented, in part, in a gaming device according to game data received from a game server. The gaming device may receive such game data through a dedicated gaming network and/or through a public data network such as the Internet.

Figure 10:
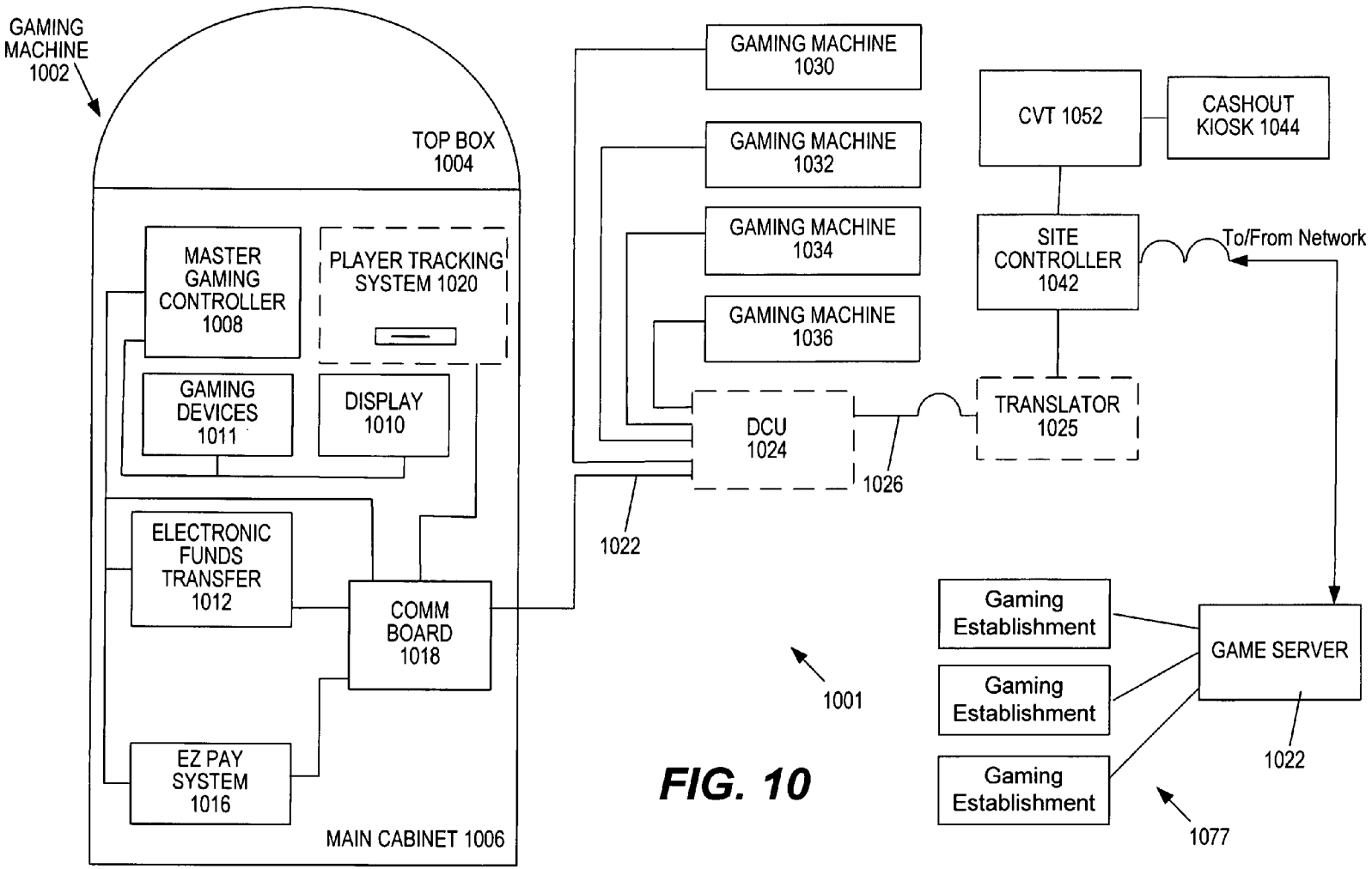
FIG. 10 is a block diagram of a number of gaming machines in a gaming network that may be configured to implement some methods of the present invention.

One example of a gaming machine network that may be used to implement methods of the invention is depicted in FIG. 10. Gaming establishment 1001 could be any sort of gaming establishment, such as a casino, a card room, an airport, a store, etc. However, the methods and devices of the present invention are intended for gaming networks (which may be in multiple gaming establishments) in which there is a sufficient number of Class II gaming machines for bingo play. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 and receives or sends data to various input/output devices 1011 on the gaming machine 1002. Details of exemplary systems for using a game server to control a network of gaming machines to implement bingo games are described in U.S. Patent Application No. 60/503,161 (client docket number P-888), filed Sep. 15, 2003 and entitled "Gaming Network with Multi-Player Bingo Game." This application has been incorporated by reference herein for all purposes. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system 1016 (a proprietary cashless ticketing system of the present assignee), and player tracking system 1020. The systems of the gaming machine 1002 communicate the data onto the network 1022 via a communication board 1018.

It will be appreciated by those of skill in the art that the present invention could be implemented on a network with more or fewer elements than are depicted in FIG. 10. For example, player tracking system 1020 is not a necessary feature of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, in the gaming industry, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machine are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cashout tickets. Moreover, CVT 1052 authorizes the exchange of a cashout ticket for cash. These processes will be described in detail below. In one example, when a player attempts to redeem a cashout ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 11:
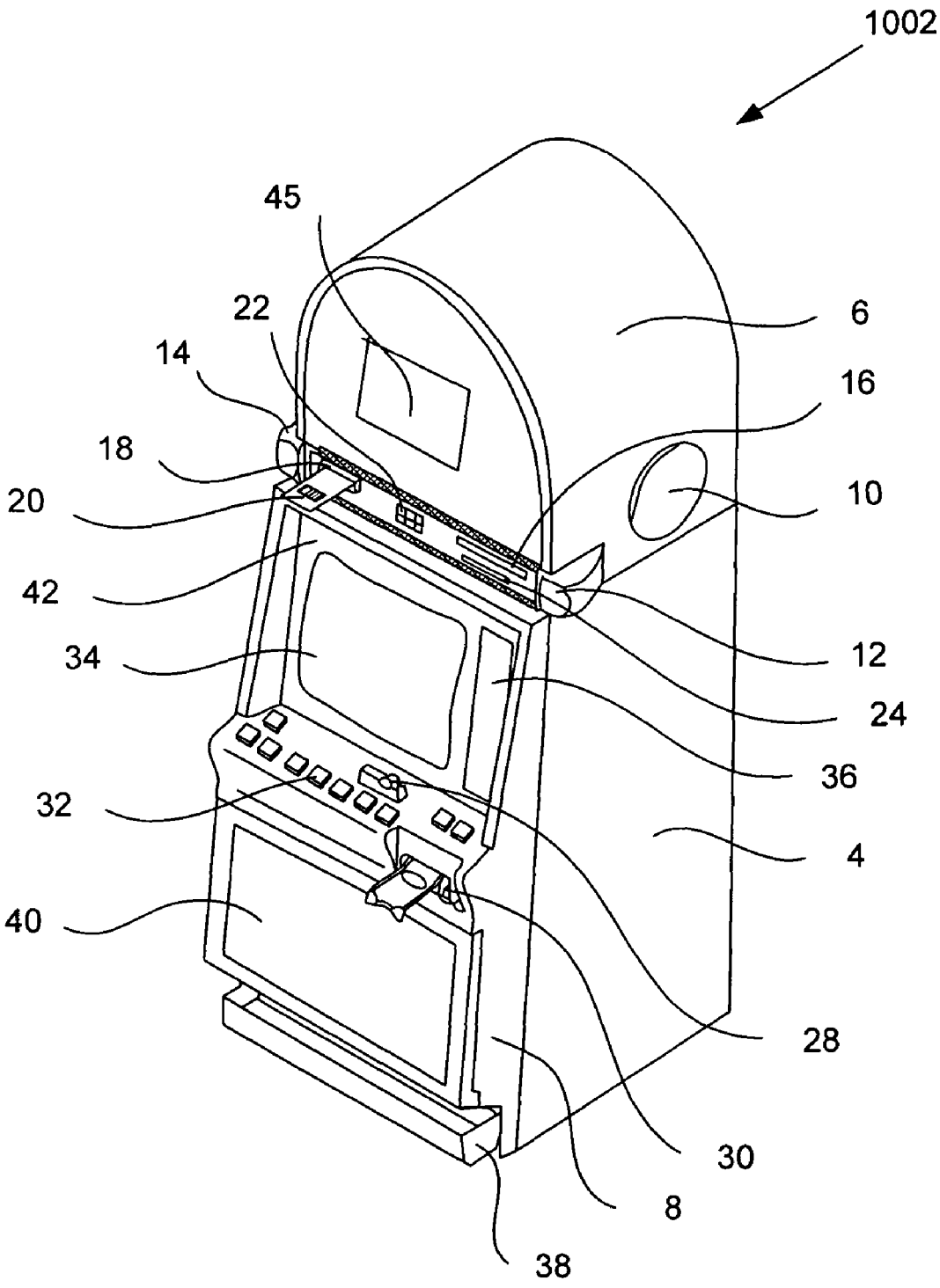
FIG. 11 illustrates an exemplary gaming machine that may be configured to implement some methods of the present invention.

Turning to FIG. 11, more details of gaming machine 1002 are described. Machine 1002 includes a main cabinet 4, which generally surrounds the machine interior (not shown) and is viewable by users. The main cabinet 4 includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, the number of coins played. The bill validator 30, player-input switches 32, video display monitor 34, and information panel are devices used to play a game on the game machine 1002. The devices are controlled by circuitry housed inside the main cabinet 4 of the machine 1002.

The gaming machine 1002 includes a top box 6, which sits on top of the main cabinet 4. The top box 6 houses a number of devices, which may be used to add features to a game being played on the gaming machine 1002, including speakers 10, 12, 14, a ticket printer 18 which may print bar-coded tickets 20 used as cashless instruments. The player tracking unit mounted within the top box 6 includes a key pad 22 for entering player tracking information, a florescent display 16 for displaying player tracking information, a card reader 24 for entering a magnetic striped card containing player tracking information, a microphone 43 for inputting voice data, a speaker 42 for projecting sounds and a light panel 44 for display various light patterns used to convey gaming information. In other embodiments, the player tracking unit and associated player tracking interface devices, such as 16, 22, 24, 42, 43 and 44, may be mounted within the main cabinet 4 of the gaming machine, on top of the gaming machine, or on the side of the main cabinet of the gaming machine.

Understand that gaming machine 1002 is but one example from a wide range of gaming machine designs on which the present invention may be implemented. For example, not all suitable gaming machines have top boxes or player tracking features. Further, some gaming machines have two or more game displays—mechanical and/or video. Some gaming machines are designed for bar tables and have displays that face upwards. Still further, some machines may be designed entirely for cashless systems. Such machines may not include such features as bill validators, coin acceptors and coin trays. Instead, they may have only ticket readers, card readers and ticket dispensers. Those of skill in the art will understand that the present can be deployed on most gaming machines now available or hereafter developed. Moreover, some aspects of the invention may be implemented on devices which lack some of the features of the gaming machines described herein, e.g., workstation, desktop computer, a portable computing device such as a personal digital assistant or similar handheld device, a cellular telephone, etc. U.S. patent application Ser. No. 09/967,326, filed Sep. 28, 2001 and entitled "Wireless Game Player," is hereby incorporated by reference for all purposes.

Returning to the example of FIG. 11, when a user wishes to play the gaming machine 1002, he or she inserts cash through the coin acceptor 28 or bill validator 30. In addition, the player may use a cashless instrument of some type to register credits on the gaming machine 1002. For example, the bill validator 30 may accept a printed ticket voucher, including 20, as an indicium of credit. As another example, the card reader 24 may accept a debit card or a smart card containing cash or credit information that may be used to register credits on the gaming machine.

During the course of a game, a player may be required to make a number of decisions. For example, a player may vary his or her wager on a particular game, select a prize for a particular game, or make game decisions regarding gaming criteria that affect the outcome of a particular game (e.g., which cards to hold). The player may make these choices using the player-input switches 32, the video display screen 34 or using some other hardware and/or software that enables a player to input information into the gaming machine (e.g. a GUI displayed on display 16).

During certain game functions and events, the gaming machine 1002 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 1002, from lights behind the belly glass 40 or the light panel on the player tracking unit 44.

After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. The type of ticket 20 may be related to past game playing recorded by the player tracking software within the gaming machine 1002. In some embodiments, these tickets may be used by a game player to obtain game services.

IGT gaming machines are implemented with special features and/or additional circuitry that differentiate them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator of a gaming machine from manipulating hardware and software in a manner that gives them an unfair and some cases an illegal advantage. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware components, software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. As noted above, some preferred embodiments of the present invention include parallel, digital interfaces for high-speed data transfer. However, even the serial devices may have electrical interface requirements that differ from the "standard" EIA RS232 serial interfaces provided by general-purpose computers. These interfaces may include EIA RS485, EIA RS422, Fiber Optic Serial, Optically Coupled Serial Interfaces, current loop style serial interfaces, etc. In addition, to conserve serial interfaces internally in the slot machine, serial devices may be connected in a shared, daisy-chain fashion where multiple peripheral devices are connected to a single serial channel.

IGT Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the trusted memory device contents in a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Gaming machines used for Class III games generally include software and/or hardware for generating random numbers. However, gaming machines used for Class II games may or may not have RNG capabilities. In some machines used for Class II games, RNG capability may be disabled.

Figure 12:
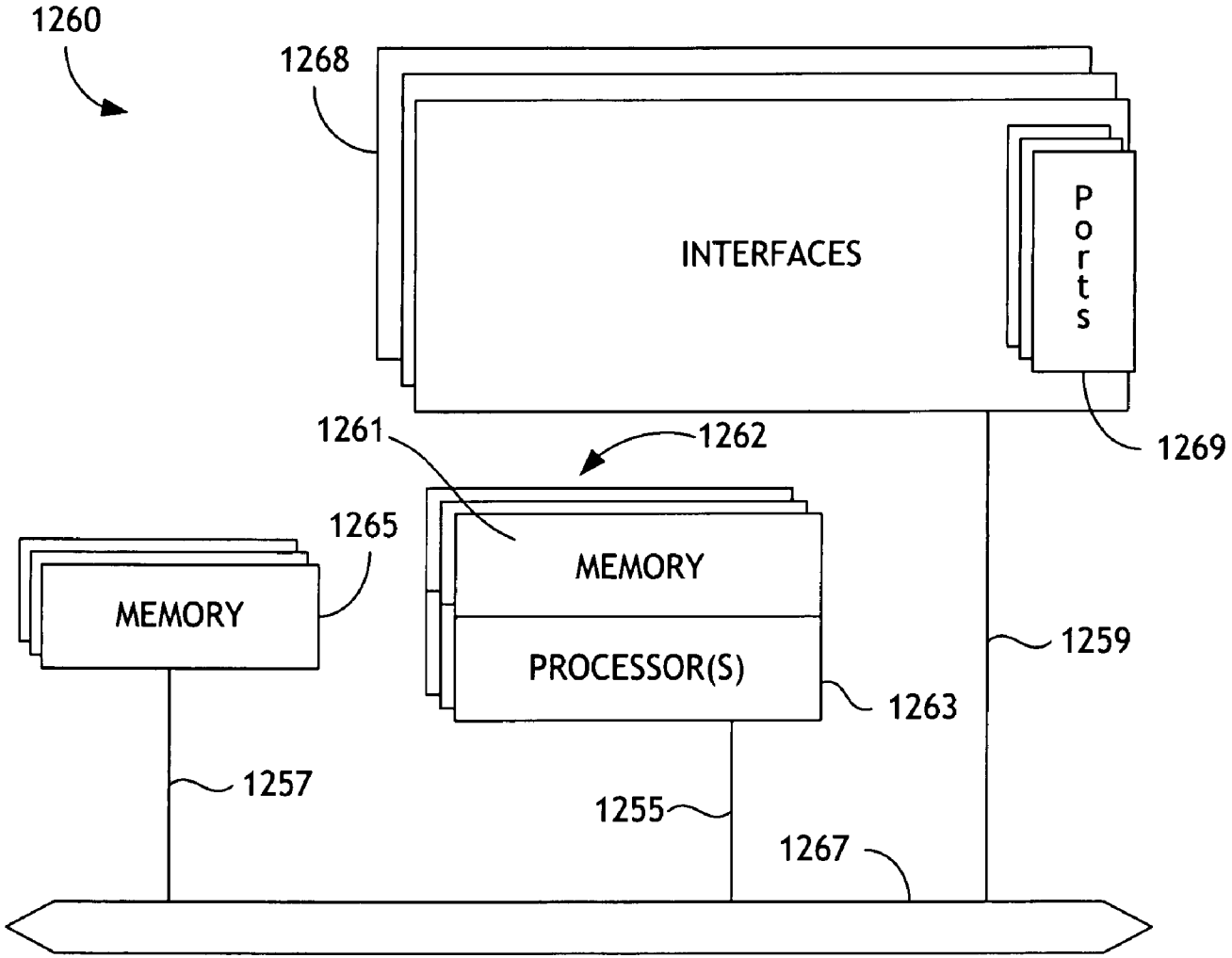
FIG. 12 is a block diagram of an exemplary network device that may be configured as a game server to implement some methods of the present invention.

FIG. 12 illustrates an example of a network device that may be configured as a game server for implementing some methods of the present invention. Network device 1260 includes a master central processing unit (CPU) 1262, interfaces 1268, and a bus 1267 (e.g., a PCI bus). Generally, interfaces 1268 include ports 1269 appropriate for communication with the appropriate media. In some embodiments, one or more of interfaces 1268 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1268 control such communications-intensive tasks as media control and management. By providing separate processors for the communications-intensive tasks, interfaces 1268 allow the master microprocessor 1262 efficiently to perform other functions such as routing computations, network diagnostics, security functions, etc.

The interfaces 1268 are typically provided as interface cards (sometimes referred to as "linecards"). Generally, interfaces 1268 control the sending and receiving of data packets over the network and sometimes support other peripherals used with the network device 1260. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1262 may be responsible for implementing specific functions associated with the functions of a desired network device. According to some embodiments, CPU 1262 accomplishes all these functions under the control of software including an operating system and any appropriate applications software.

CPU 1262 may include one or more processors 1263 such as a processor from the Motorola family of microprocessors or the MIPS family of microprocessors. In an alternative embodiment, processor 1263 is specially designed hardware for controlling the operations of network device 1260. In a specific embodiment, a memory 1261 (such as non-volatile RAM and/or ROM) also forms part of CPU 1262. However, there are many different ways in which memory could be coupled to the system. Memory block 1261 may be used for a variety of purposes such as, for example, caching and/or storing data, programming instructions, etc.

Regardless of network device's configuration, it may employ one or more memories or memory modules (such as, for example, memory block 1265) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to non-transitory machine-readable media that include program instructions, state information, etc. for performing various operations described herein. Examples of non-transitory machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). Examples of program instructions include both machine code, such as produced by a compiler, and files containing higher-level code that may be executed by the computer using an interpreter.

Although the system shown in FIG. 12 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 12) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention.

Although the foregoing invention has been described in some detail for purposes of clarity of understanding, it will be apparent that certain changes and modifications may be practiced within the scope of the appended claims.

The invention claimed is:

1. A method for compensating for a player choice in a game of chance on a gaming machine, the method comprising the steps of:

defining a plurality of outcomes, the outcomes displayed on the gaming machine;

providing a sequence of positions on the gaming machine;

providing a reference position associated with one of the positions in the sequence of positions ;

providing a plurality of pointers, each pointer associated with a different position in the sequence of positions and having an offset value with respect to the reference position along the sequence of positions;

positioning, responsive to a selection of one of the pointers, the reference position according to the offset value associated with the selected one pointer, so that the reference position is associated with a position in the sequence of positions indicated by the selected one pointer;

receiving a number determining one outcome of the plurality of outcomes according to a predefined probability associated with the reference position; and outputting the determined one outcome at the position associated with the reference position as positioned according to the offset value.

2. The method of claim 1, wherein a player chooses the selected one pointer.

3. The method of claim 1, wherein the selected one pointer is chosen using a random number pick.

4. The method of claim 1, wherein the number determining the one outcome is generated in a Bingo game.

5. The method of claim 1, wherein a random number generator generates the number determining the one outcome.

6. The method of claim 5, wherein the random number generator is non-deterministic.

7. The method of claim 5, wherein the random number generator is deterministic.

8. The method of claim 1, wherein the pluralit f outcomes is disposed about a wheel.

9. The method of claim 1, wherein the plurality of outcomes is disposed about a sphere.

10. The method of claim 1, wherein the plurality of outcomes is disposed on a reel.

11. The method of claim 1, wherein the plurality of outcomes comprises award amounts.

12. The method of claim 1, wherein the plurality of outcomes comprises bingo award amounts.

13. The method of claim 1, wherein the plurality of outcomes comprise stops.

14. The method of claim 1, further comprising the step of:

providing a pay table, the pay table storing the predefined probability as one of a plurality of probabilities for the plurality of outcomes.

15. The method of claim 14, wherein the probabilities in the plurality of probabilities are equal.

16. The method of claim 1, wherein the reference position is positioned according to the result of a modulo operation in which the number of positions in the sequence of positions is the divisor of the modulo operation and the reference position combined with the offset value is the dividend of the modulo operation.

17. A system for compensating for a player choice in a game of chance, the system comprising:

a central computer operable to output a random number seed; and a gaming machine in communication with the central computer over a data network to receive the random number seed, the gaming machine comprising a game display of a plurality of pointers and a plurality of outcomes, the gaming machine operable to execute a game application configured to:

i) provide a sequence of positions, each pointer in the plurality of pointers associated with a different position in the sequence of positions, ii) provide a reference position associated with one of the positions in the sequence of positions, iii) accept a selection of a selected one pointer from the plurality of pointers, each pointer having an offset value, the offset value for each pointer defined with respect to the position in the sequence of positions associated with the defined reference position and the position in the sequence of positions associated with the pointer , iv) position, responsive to the selection of the selected one pointer, the reference position according to the offset value of the selected one pointer, so that the reference position is associated with the position in the sequence of positions associated with the selected one pointer, v) generate a random number based on a received random number seed, the random number determining one outcome of the plurality of outcomes according to a predefined probability associated with the reference position, and vi) output the determined one outcome at the position associated with the reference position as positioned according to the offset value.

18. The system of claim 17, wherein the random number determining the one outcome is generated in a Bingo game.

19. The system of claim 17, wherein the plurality of outcomes is disposed about a wheel.

20. The system of claim 17, wherein the plurality of outcomes is disposed about a sphere.

21. The system of claim 17, wherein the plurality of outcomes is disposed on a reel.

22. The system of claim 17, wherein the plurality of outcomes comprises award amounts.

23. The system of claim 17, wherein the plurality of outcomes comprises bingo award amounts.

24. The system of claim 17, wherein the plurality of outcomes comprises stops.

25. A computer program product, stored on a non-transitory processor readable medium, comprising instructions operable to cause a computer to perform a method for compensating for a player choice in a game of chance on a gaming machine, the game of chance involving a display of a plurality of outcomes and a plurality of pointers on the gaming machine, the method comprising the steps of:

providing a sequence of positions, each pointer in the plurality of pointers associated with a different position in the sequence of positions;

providing a reference position associated with one of the positions in the sequence of positions;

accepting a selection of one pointer from the plurality of pointers, each pointer in the plurality of pointers having an offset value, the offset value for each pointer defined with respect to the position in the sequence of positions associated with the reference position and the position in the sequence of positions associated with the pointer;

positioning, responsive to the selection of the one pointer, the reference position according to the offset value of the selected one pointer, so that the reference position is associated with the position in the sequence of positions associated with the selected one pointer;

receiving a number determining one outcome of the plurality of outcomes according to a predefined probability associated with the reference position; and outputting the determined one outcome at the position associated with the reference position as positioned according to the offset value.

26. The computer program product of claim 25, wherein the number determining the one outcome is generated in a Bingo game.

27. The computer program product of claim 25, wherein a random number generator generates the number determining the one outcome.

28. The computer program product of claim 25, wherein the random number generator is non-deterministic.

29. The computer program product of claim 28, wherein the random number generator is deterministic.

30. The computer program product of claim 25, wherein the plurality of outcomes is disposed about a wheel.

31. The computer program product of claim 25, wherein the plurality of outcomes is disposed about a sphere.

32. The computer program product of claim 25, wherein the plurality of outcomes is disposed on a reel.

33. The computer program product of claim 25, wherein the plurality of outcomes comprises award amounts.

34. The computer program product of claim 25, wherein the plurality of outcomes comprises stops.

* * * * *

UNITED STATES PATENT AND TRADEMARK OFFICE

CERTIFICATE OF CORRECTION

PATENT NO. : 7,833,092 B2
APPLICATION NO. : 11/020416
DATED : November 16, 2010
INVENTOR(S) : Bryan D. Wolf et al.

It is certified that error appears in the above-identified patent and that said Letters Patent is hereby corrected as shown below:

CLAIMS:

(column 28, line 64)
change “pluralit f” to --plurality of--.

Signed and Sealed this
Eighteenth Day of January, 2011

David J. Kappos

David J. Kappos
*Director of the United States Patent and Trademark Office*